US007263986B2

(12) United States Patent
Lovell

(10) Patent No.: US 7,263,986 B2
(45) Date of Patent: Sep. 4, 2007

(54) AUTOMATIC SINGLE STACK TRAP MACHINE

(75) Inventor: Tom Lovell, Goshen, IN (US)

(73) Assignee: Leader Components, Inc., Syracuse, IN (US)

( * ) Notice: Subject to any disclaimer, the term of this patent is extended or adjusted under 35 U.S.C. 154(b) by 0 days.

(21) Appl. No.: 11/016,239

(22) Filed: Dec. 17, 2004

(65) Prior Publication Data

US 2006/0065258 A1 Mar. 30, 2006

Related U.S. Application Data

(60) Provisional application No. 60/613,893, filed on Sep. 27, 2004.

(51) Int. Cl.
*F41J 9/18* (2006.01)

(52) U.S. Cl. ..... 124/9

(58) Field of Classification Search ..... 124/8, 124/9

See application file for complete search history.

(56) References Cited

U.S. PATENT DOCUMENTS 663,090 A 12/1900 Pike
2,124,738 A 7/1938 Johnsen
2,978,700 A 4/1961 Stevens et al.
3,070,082 A * 12/1962 Foster ..... 124/8
3,225,754 A * 12/1965 Foster ..... 124/9
3,677,257 A * 7/1972 Segerkvist ..... 124/8
3,690,662 A 9/1972 Pasqualini
3,722,495 A * 3/1973 Hansen ..... 124/9
3,821,945 A * 7/1974 Foster ..... 124/9
4,076,004 A 2/1978 Huelskamp
4,677,961 A 7/1987 Allison

* cited by examiner

*Primary Examiner*—John A. Ricci
(74) *Attorney, Agent, or Firm*—Darby & Darby

(57) ABSTRACT

A clay target launching machine includes a magazine containing a predetermined number of clay targets; a first motor assembly; a throwing arm operatively coupled to the first motor assembly such that actuation of the first motor assembly is translated into pivoting of the throwing arm to launch the clay target; a housing that is pivotable about a base and supports, at least in part, the magazine, the first motor assembly, and the throwing arm; and an automatic trajectory changer assembly including a second motor that is operatively coupled to the housing through a linkage such that rotation of a drive shaft of the second motor is translated into vertical and lateral movement of the housing relative to the base; wherein the first motor assembly operates at a different speed than the second motor.

30 Claims, 13 Drawing Sheets

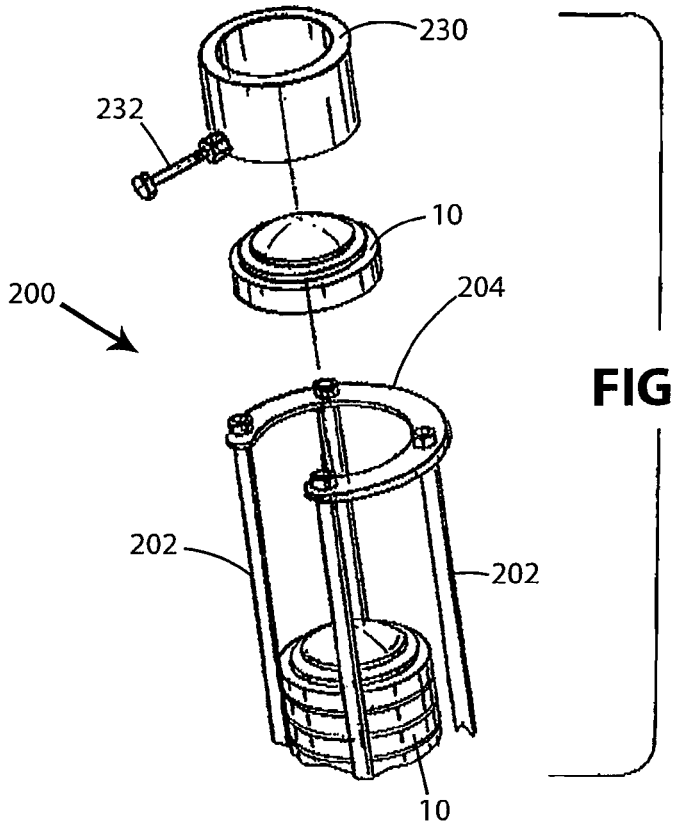
FIG. 8
FIG. 9
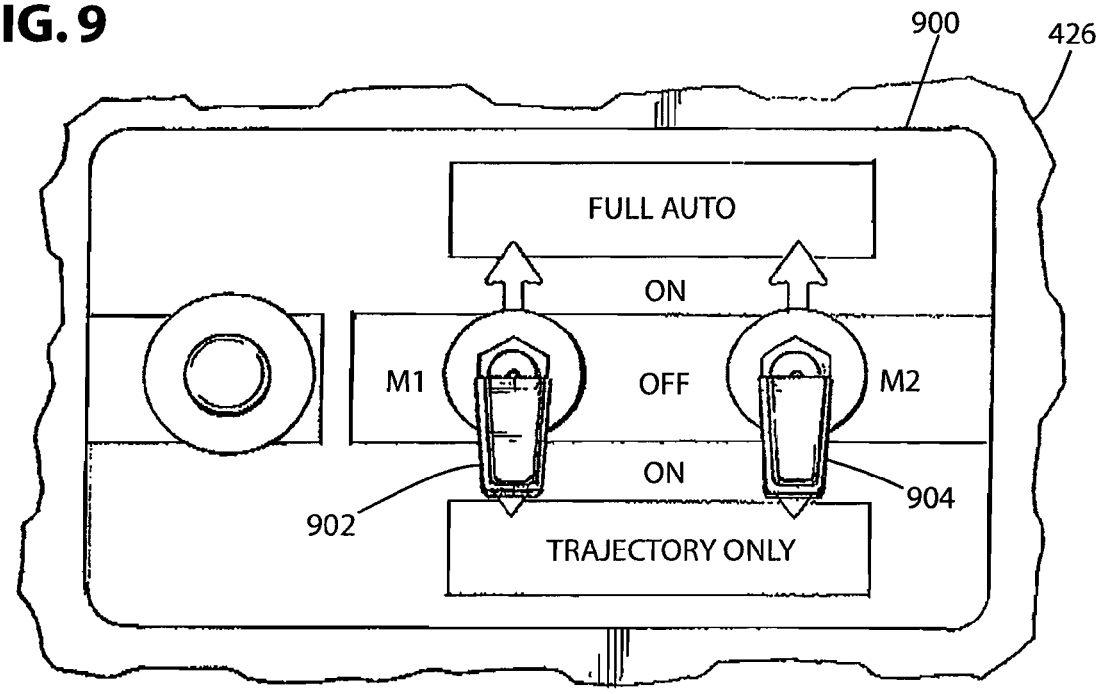

AUTOMATIC SINGLE STACK TRAP MACHINE

CROSS-REFERENCE TO RELATED APPLICATION

This application claims the benefit of U.S. Provisional Patent Application No. 60/613,893, filed Sep. 27, 2004.

TECHNICAL FIELD

The present invention relates to trap machines that shoot clays, and more particularly, relates to a trap machine that can automatically change the trajectory of each target clay as the machine is operated in one mode.

BACKGROUND

Trap machines are conventionally used to shoot sporting clays, skeet, and trap. Sporting clays involves shooting clays at various locations which are launched at different velocities and angles, i.e., across the shooter's view, towards the shooter, or away from the shooter. This experience closely resembles actual hunting conditions since the sporting clays can be shot to resemble quail, pheasants, doves, and other game birds, as well as high-flying ducks or geese. Thus, it is more difficult for shooters to become accustomed to the shots as they might for trap or skeet shooting.

Skeet shooting involves shooting clays which are flung into the air at high speed and is meant to simulate the action of bird hunting. In one conventional arrangement, the shooter can be positioned along a semi-circle connecting two launching stations, a high house target and a low house target. The high house target launches the target from a point up to 10 feet above ground, and the low house target launches the target from a point up to 3 feet off above ground.

Trap shooting involves shooting clays which are launched from a single launching location, namely, a trap house positioned at a distance in front of the shooter, at varying angles within a range of 45 degrees to the left or right of a center position from the trap house. The shooter rotates to several different positions relative to the trap house.

Whether for shooting sporting clays, skeet, or trap, a conventional trap machine has a spring-loaded throwing arm for launching the clays. However, conventional trap machines are designed to shoot clays at a single trajectory angle. Even if the conventional trap machine is adapted to allow the user to adjust the trajectory angle, the conventional trap machines are typically manually adjustable and require the user to set the trap machine to the desired trajectory angle. Thus, the operation of such a machine is rather cumbersome and require considerable effort.

Furthermore, conventional trap machines are difficult to maintain. When parts, such as the threads in the connection between the magazine and the housing, become worn due to the vibration of the trap machine when releasing and launching the clays, major components including the main deck must be replaced, and often, the user will replace the entire machine rather than replace the major components of the trap machine.

Conventional trap machines also often break the clays due to excessive vibrations from a lack of rigidity in the structure of the trap machine and mistiming between the release of the clay and the swing of the throwing arm. Conventional trap machines are also typically limited to holding 70 clays in a single stack trap machine.

What has heretofore not been available is a reliable trap machine that automatically changes the trajectory angle, is easy to maintain, is capable of storing more than 70 clays in a single stack, and accurately times the throwing arm with the release of the clay.

SUMMARY

A clay target launching machine, according to one aspect of the present invention, includes a magazine containing a predetermined number of clay targets; a first motor assembly; a throwing arm operatively coupled to the first motor assembly such that actuation of the first motor assembly is translated into pivoting of the throwing arm to launch the clay target; a housing that is pivotable about a base and supports, at least in part, the magazine, the first motor assembly, and the throwing arm; and an automatic trajectory changer assembly including a second motor that is operatively coupled to the housing through a linkage such that rotation of a drive shaft of the second motor is translated into vertical and lateral movement of the housing relative to the base so as to cause a continuous change in an angle at which the throwing arm is positioned when launching clays, thereby causing a variable trajectory path for successively launched clay targets; wherein the first motor assembly operates at a different speed than the second motor.

A clay target launching machine, according to another aspect of the present invention, includes a magazine containing a predetermined number of clay targets; a first motor assembly; a throwing arm operatively coupled to the first motor assembly such that actuation of a first motor of the first motor assembly is translated into pivoting of the throwing arm to launch the clay target; a housing that is pivotable about a base and supports, at least in part, the magazine, the first motor assembly, and the throwing arm; an automatic trajectory changer assembly including a second motor that is operatively coupled to the housing through a linkage; and a control panel that permits a user to select between a first operation mode and a second operational mode, the first operational mode being one where both the first and second motors are powered causing the launcher to launch the clays along continuously changing trajectory paths, the second operational mode being one where only the first motor is operational and the launcher launches clays continuously along a substantially fixed trajectory path.

A clay target launching machine, according to another aspect of the present invention, includes a magazine containing a predetermined number of clay targets; a launching device for launching one of the clay targets; a main motor assembly supporting at least a part of the magazine, the main motor assembling comprising a main motor that activates the launching device; and an automatic trajectory changer assembly comprising: a trajectory gear motor that automatically changes the orientation of the main motor assembly and a trajectory of the clay target; a pivot base disposed under a housing of the main motor assembly; and a linkage connected to the main motor assembly; wherein: the trajectory gear motor transfers rotational motion to the linkage; and the linkage transfers the rotational motion to the main motor assembly, thereby causing the main motor assembly to pivot with respect to the pivot base, thereby changing the trajectory of the launched clay target.

A clay target launching machine, according to another aspect of the present invention, includes a magazine containing a predetermined number of clay targets; a launching device for launching one of the clay targets; a main motor assembly comprising a main motor that activates the launching device and at least one replaceable thread plate, the magazine being mounted to the thread plate; and an automatic trajectory changer assembly comprising a trajectory gear motor that automatically changes the orientation of the main motor assembly and a trajectory of the clay target.

A clay target launching machine, according to another aspect of the present invention, includes a magazine containing a predetermined number of clay targets; a throwing arm for launching one of the clay targets; a main motor assembly supporting at least a part of the magazine, the main motor assembling comprising: a main motor that activates the launching device; and a cam cap comprising a cam portion and a shaft portion with a rounded portion and a timing flat; and a snap switch; and an automatic trajectory changer assembly comprising a trajectory gear motor that automatically changes the orientation of the main motor assembly and a trajectory of the clay target, wherein: the throwing arm rotates when the snap switch contacts the rounded portion of the shaft portion of the cam cap; and the throwing arm stops rotating when the snap switch contacts the timing flat of the shaft portion of the cam cap.

BRIEF DESCRIPTION OF THE DRAWINGS

The foregoing and other features of the present invention will be more readily apparent from the following detailed description and drawings of the illustrative embodiments of the invention wherein like reference numbers refer to similar elements and in which:

FIG. 8 is an exploded view of the magazine of the trap machine of FIG. 1;

FIG. 9 is a sectional view of a control panel of the trap machine of FIG. 1;

DETAILED DESCRIPTION OF THE PREFERRED EMBODIMENTS

FIGS. 1-14 illustrate an embodiment of an exemplary automatic single stack trap machine 100, which can be used for shooting clays (clay pigeons) 10 such as for shooting sports such as sporting clays, skeet, or trap. However, it will be understood that the present invention can be used for shooting various types of objects for other purposes. The inventive concepts of the present invention can be incorporated into various types of launchers so that they become easy to maintain, structurally stable, able to accurately time the release of the launched object with the swing of a propelling member, e.g., an arm that launches the object, and able to continuously change the trajectory angle of the launched object by adjusting the positioning of the trap machine along multiple axes.

Structure

Figure 1:
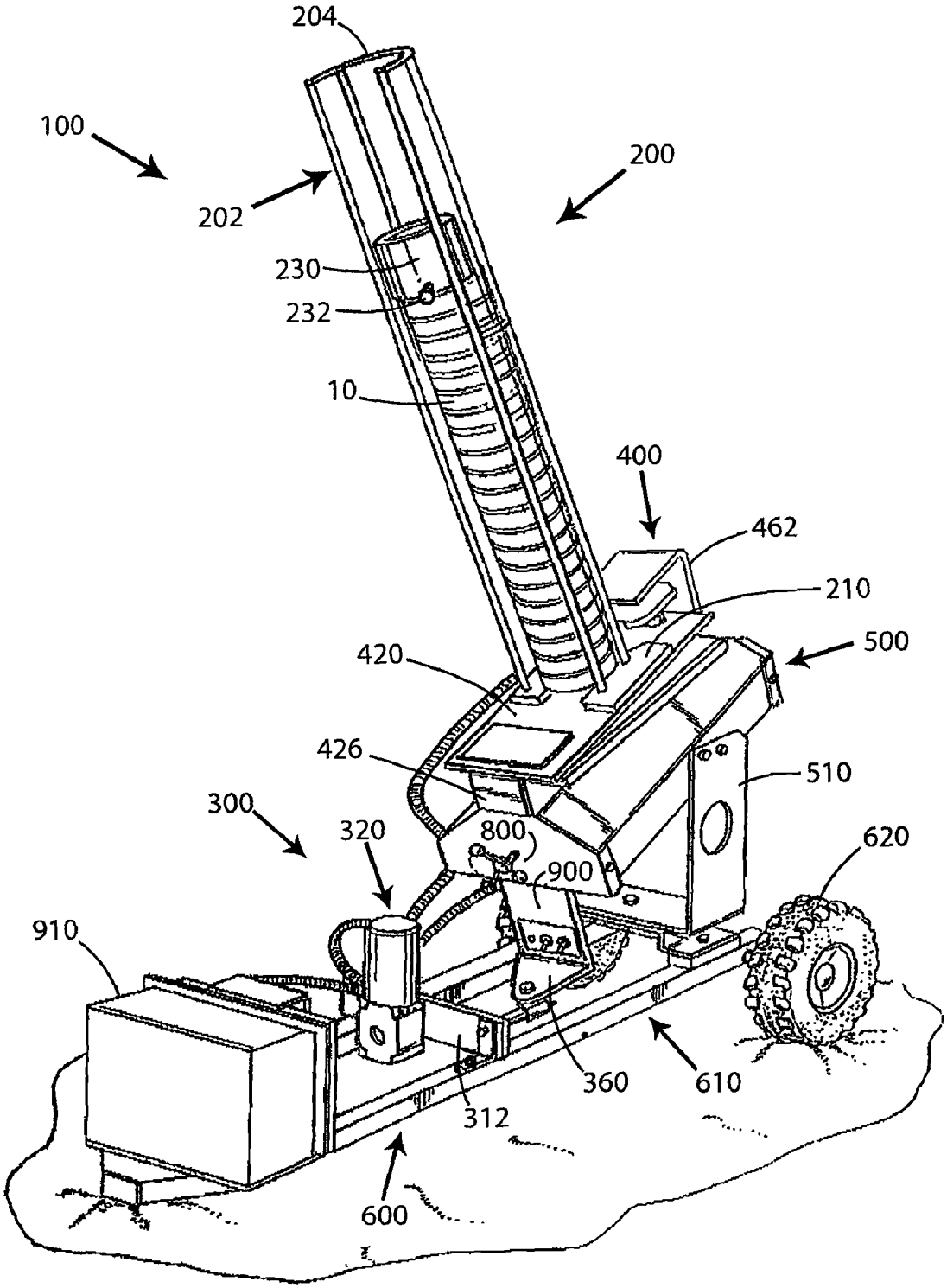
FIG. 1 is a perspective view of a trap machine according to an embodiment of the present invention.
Figure 2:
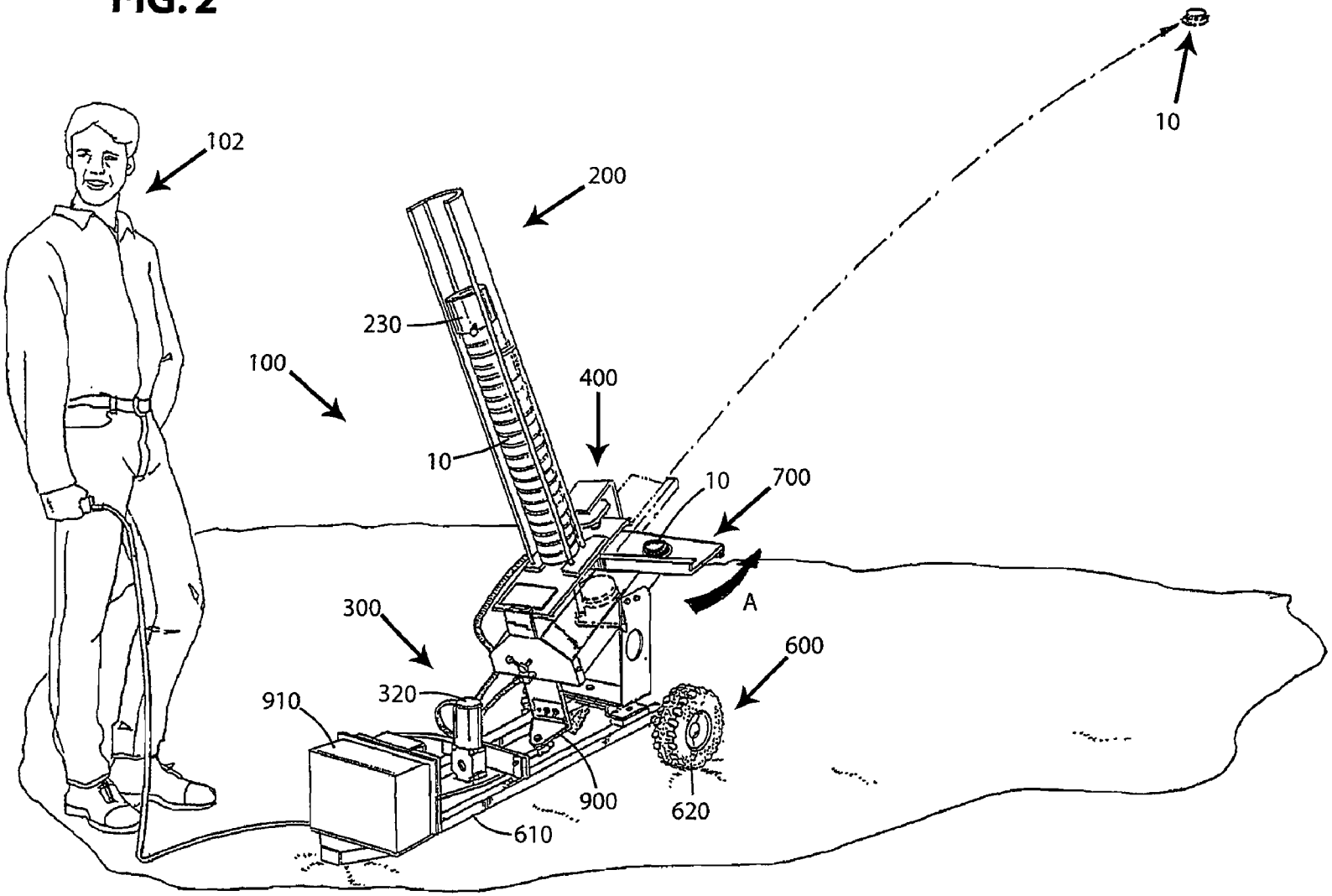
FIG. 2 is a perspective view of the trap machine of FIG. 1 after launching a clay.
Figure 3:
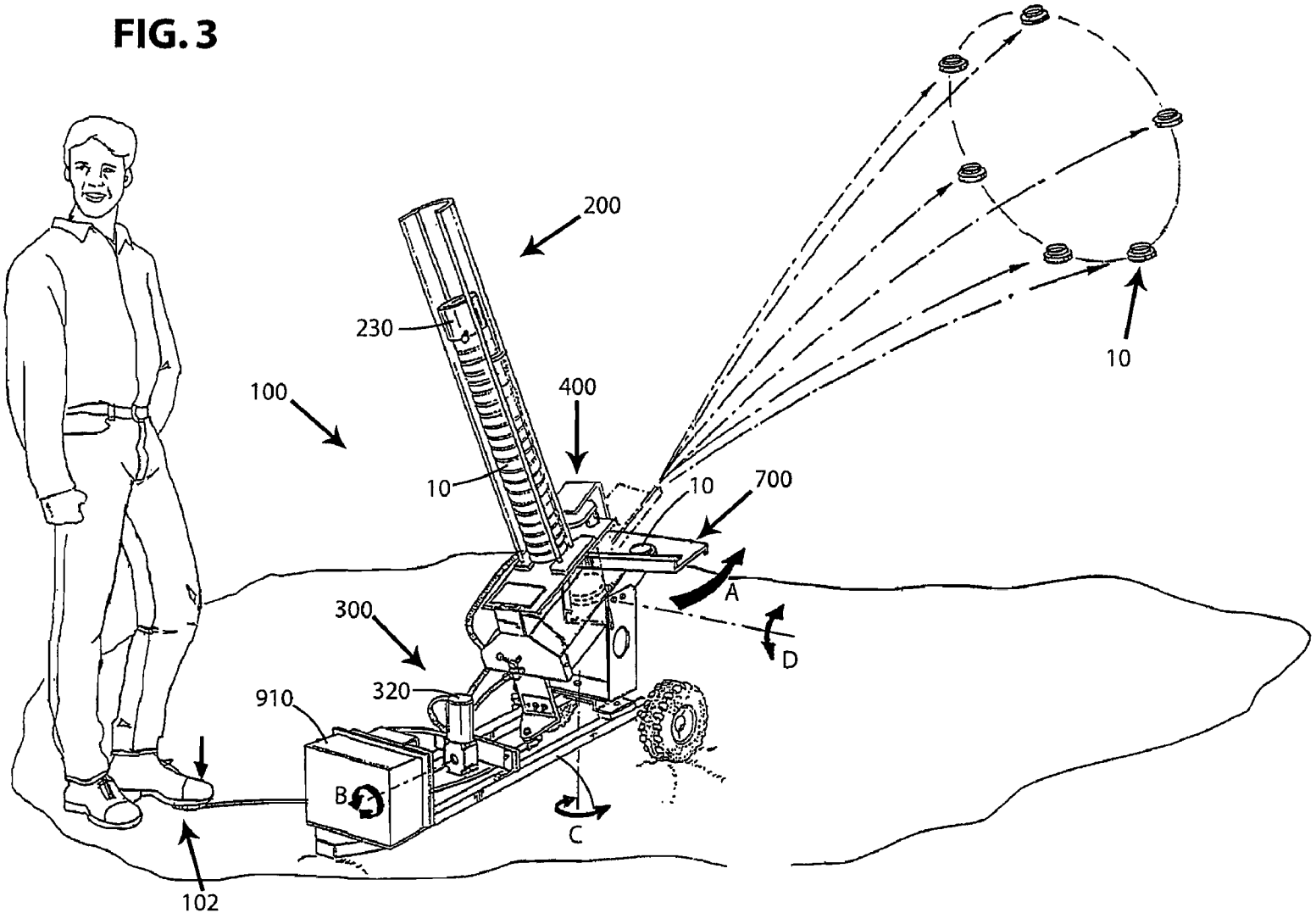
FIG. 3 is a perspective view of the trap machine of FIG. 1 showing a possible conical trajectory field.

FIG. 1 is a perspective view of a trap machine 100 which launches clays one by one according to an embodiment of the present invention; FIG. 2 is a perspective view of the trap machine 100 after launching a clay 10 when the throwing arm 700 moves to the cocked position; and FIG. 3 is a perspective view of the trap machine 100 showing a possible conical trajectory field. The trap machine 100 includes a magazine 200, an automatic trajectory changer assembly 300, a main motor assembly 400, and a housing 500 supported by a housing base 510.

The magazine 200 stores the clays 10, and deposits a clay one-by-one into the main motor assembly 400. The magazine 200 of the present invention typically stores at least 80 clays 10. The main motor assembly 400 launches the clays 10 and is operatively coupled to the automatic trajectory changer assembly 300, which varies the trajectory at which the clays 10 are launched. The housing 500 and the housing base 510 both contain and support the main motor assembly 400, and allow the housing 500 and the main motor assembly 400 to pivot with respect to multiple axes of motion. The trajectory changer assembly 300 includes a trajectory gear motor 320 operatively coupled to a rear end of the housing 500, and moves the housing 500 and the main motor assembly 400 so that they pivot with respect to multiple axes of motion. Preferably, the entire trap machine 100 is supported by and carried on a frame 600 such that it can be easily moved from one location to another location. For example, and as shown in the Figures, the frame 600 can be in the form of two or more spaced rails 610 that are connected at one end thereof to a pair of wheels 620 to permit the entire machine 100 to be moved. The opposite ends of the rails 610 can be coupled to a hitch assembly or the like that permits the frame 600, and the carried machine 100, to be attached to a vehicle or the like (not shown) that can essentially tow the frame 600 and machine 100 from one location to another. It will also be appreciated that a brake mechanism can be built into the frame 600. Alternatively, the frame 600 can be fixed to the ground.

Automatic Trajectory Changer Assembly

Figure 4:
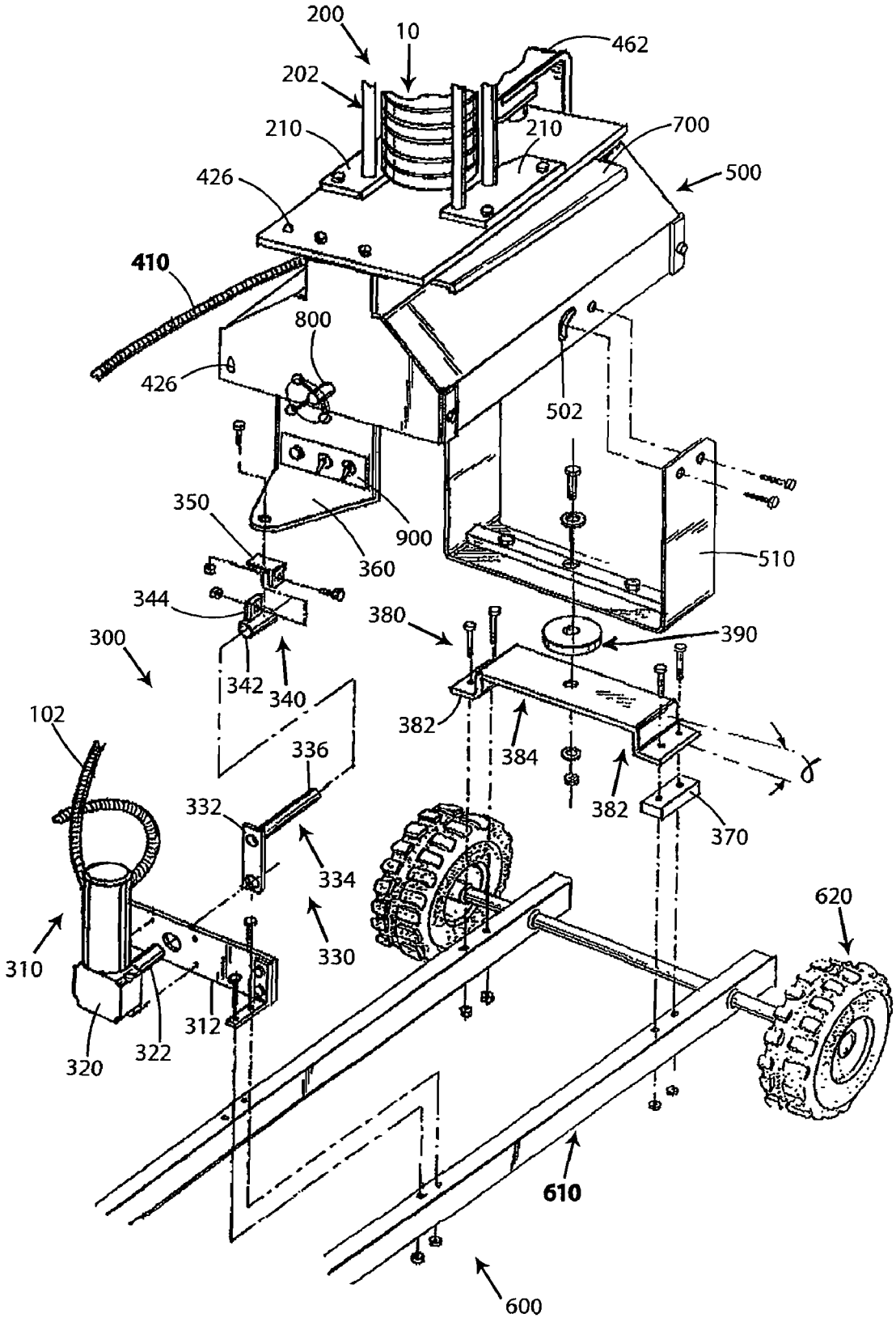
FIG. 4 is an exploded view of an automatic trajectory changer assembly of the trap machine of FIG. 1.
Figure 5:
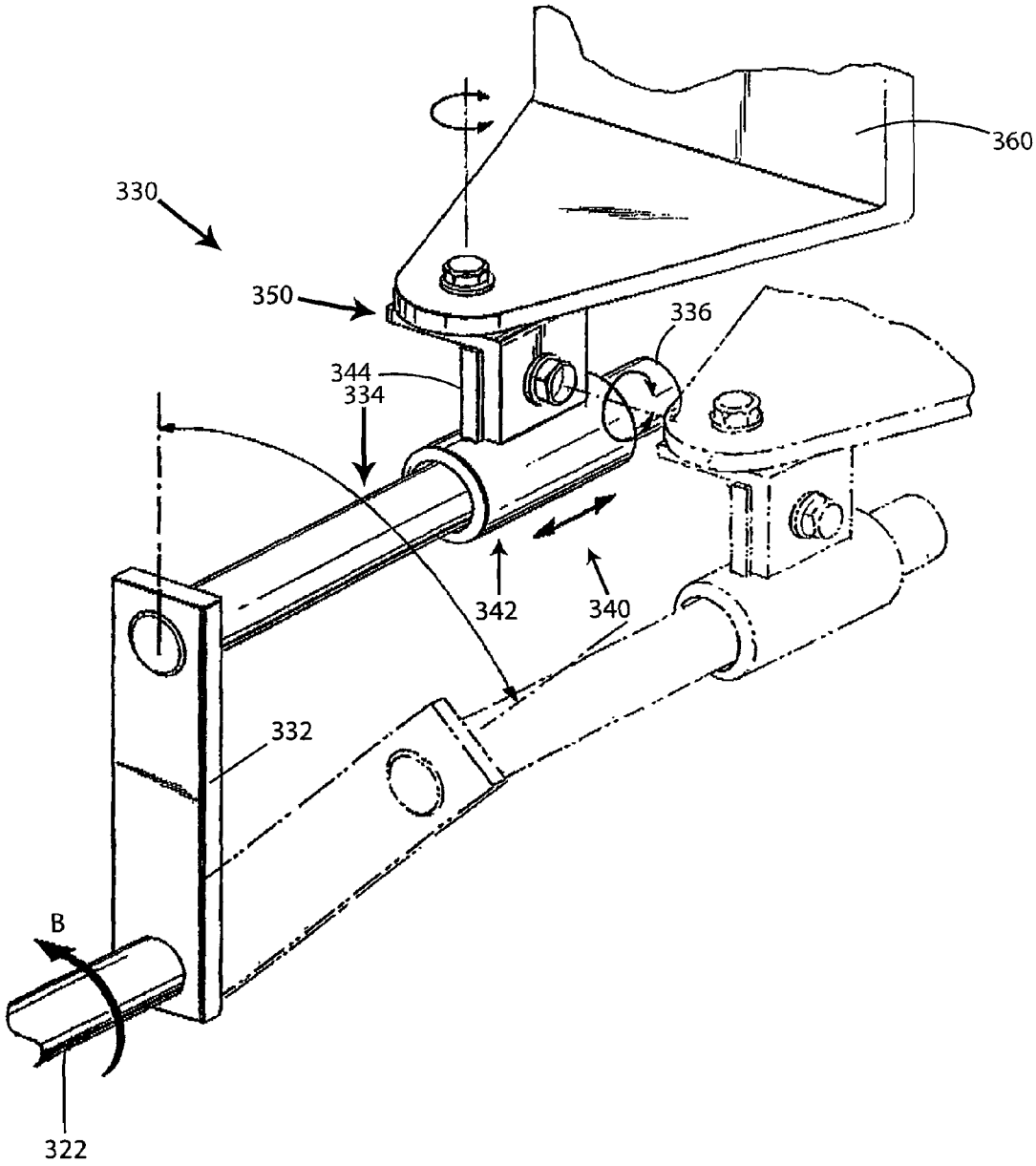
FIG. 5 is an exploded view of a crank assembly of the automatic trajectory assembly of the trap machine of FIG. 1.

FIG. 4 is an exploded view of the automatic trajectory changer assembly 300 of the trap machine 100, and FIG. 5 is an exploded view of a crank assembly of the automatic trajectory assembly 300 of the trap machine 100.

The automatic trajectory changer assembly 300 includes a trajectory motor assembly 310 formed of a motor mounting bracket 312 that is fastenly attached to the frame 610. For example, the motor mounting bracket 312 can be arranged across the space between the rails 610 such that the opposite ends of the bracket 312 are attached to the opposing rails 610, respectively, as shown in FIGS. 1-4. The trajectory motor assembly 310 further includes: the trajectory gear motor 320, a crank mechanism 330, a slip-tube 340, a link 350, a tail bracket 360, a list support block 370, a pivot base 380, and a spacer disk 390, all of which are described below in detail.

The trajectory gear motor 320 is fixedly mounted to a front surface (or rear surface) of the motor mounting bracket 312 and controls the angle at which the throwing arm is positioned when launching the clays as described below in great detail and as a result of the manner of coupling and transferring the action of the gear motor 320 to the housing 500 and the main motor assembly 400 for that matter. According to one embodiment of the invention, the trajectory gear motor 320 is a 12 volt DC magnetic right-angle gear motor mounted vertically with a drive shaft 322 thereof facing forward toward the front of the trap machine 100. The shaft 322 is mounted to a clevis 332 that is formed as part of the crank mechanism 330 such that the shaft 322 interlocks with the clevis 332. The crank mechanism 330 also includes a rod or second shaft 334 that faces forward toward the front of the trap machine 100 in a similar fashion to the drive shaft 322. The rod 334 is mounted to the clevis 332 so that the drive shaft 322 of the trajectory gear motor 320 is offset from the rod 334. In other words, the two shafts 322, 334 are not axially aligned with one another. The rod 334 is mounted to the clevis 332 in such a way that the two rotate in unison.

The slip-tube 340 is slidingly mounted onto a free end (distal end) 336 of the rod 334 such it can free slide longitudinally along the length of the rod 334. In the illustrated embodiment, the slip-tube 340 has a base portion 342 that has a bore formed therethrough for receiving the rod 344. A coupling or fastening feature 344 is formed as part of the slip-tube 340 to permit coupling between the slip-tube 340 and another member and more particularly, the feature 344 can be in the form of a tab or protrusion that extends outwardly from the base portion 342 and includes an opening formed therein. In the illustrated embodiment, the slip-tube 340 is fixedly mounted to the link 350, which can be in the form of a right-angle or L-shaped link, that attaches a top end (feature 344) of the slip-tube 340 to an underside of the tail bracket 360. Controls, which are described below, can be conveniently mounted to the tail bracket 360 since this is an area that is easily accessible by the user when the user assumes a traditional shooting position. As is apparent from the Figures, the housing 500 is supported by and mounted to a top surface of the tail bracket 360.

As will be apparent below during the discussion of the operation of the trap machine 100, this type of coupling between the automatic trajectory changer assembly 300 and the housing 500, as well as the main motor assembly 400, permits the position of the housing 500 to be constantly changed from one clay launch to the next clay launch, thereby resulting in a continuously changing trajectory angle of the launched object when the user operates the machine 100 in a mode where the automatic trajectory changer assembly 300 is activated (turned on). The automatic trajectory changer assembly 300 is positioned relative to the frame 600 such that the frame 600, more particularly, the rails 610 thereof, accommodate the movement of the automatic trajectory changer assembly 300. For example, the automatic trajectory changer assembly 300 can be disposed between the rails 610 such that during operation thereof, the crank mechanism 330, the slip-tube 340 and the link 350 are free to rotate and the tail bracket 360 is permitted to move in an up/down and/or left/right motion.

The housing 500 is pivotably supported by the housing base 510, which in turn is supported by the spacer disk 390 and the pivot base 380. The pivot base 380 preferably extends across between the rails 610 and is fastenly attached to the spaced rails 610 so as to securely ground the housing 500 to the frame 600. In the illustrated embodiment, the pivot base 380 has a pair of side members 382 that are disposed over and attached to the rails 610, as well as a raised portion 384 that is formed between and is elevated relative to the side members 382. It is on a planar surface of the raised portion 384 that the housing base 510 sits and is attached thereto with the spacer disk 390 being disposed therebetween.

One side (i.e., one side member 382) of the pivot base 380 is supported by the list support block 370, which causes the supported structure, including the spacer disk 390, the pivot base 380, housing base 510, and housing 500 to tilt a predetermined angle $\gamma$. Similarly, the list support block 370 will result in the main motor assembly 400 and the magazine 200 tilting by the predetermined angle $\gamma$ toward the left side (facing forward). The tilt angle $\gamma$ produced by the list support block 370 can be selected and varied by simply changing the actual construction of the block 370 and/or the manner of mounting the block 370. For example and according to one exemplary embodiment, the list support block 370 can tilt the supported structure 8 degrees; however, it will be appreciated that this is merely exemplary in nature and that other tilt angles can be chosen.

The tilt ensures that these components tilt the predetermined angle $\gamma$ (e.g., 8°) so that when the clay 10 drops, the clay 10 tends to slide into a throwing arm 700, which is part of the main motor assembly 400, due to gravity. Thus, even if the clay dropping motion were mistimed or if the throwing arm 700 were dirty, the clay 10 maintains a consistent position on the throwing arm 700. Otherwise, without the 8° list, the clay 10 would have a tendency to rest away from the throwing arm 700 which would cause the throwing arm 700 to strike the clay if the clay dropping motion were mistimed or if the throwing arm 700 were dirty.

The trajectory gear motor 320 is connected to a conventional power supply and when power is supplied thereto, the drive shaft 322 rotates is the direction of arrow B of FIG. 3, thereby rotating the clevis 332 of the crank mechanism 330, which interlocks with the drive shaft 322. However, since the rod 334 is mounted to the clevis 332 such that the drive shaft 322 of the trajectory gear motor 320 is offset from the rod 334, the rod 334 rotates around an axis that is colinear with the drive shaft 322, but the rod 334 and the drive shaft 322 are not colinear themselves due to the offset distance between them. The radius of the path of the rod's circle of rotation is equal to the offset distance between the drive shaft 322 and the rod 334.

As the rod 334 rotates around the drive shaft 322 of the trajectory gear motor 320, the distance between the free end of the rod 334 and the tail bracket 360 changes. The vertical and lateral (left-right) movement of the rod 334 is transferred to the slip-tube 340, right-angle link 350, and tail bracket 360 that is locate at the rear of the main motor assembly 400. To prevent binding between the trajectory gear motor 320 and the main motor assembly 400 and housing 500, the slip-tube 340 is designed to slide longitudinally over the free end 336 of the rod 334. Another mechanism that helps to prevent binding of the trap machine 100 is the spacer disk 390, which acts as a bearing surface of the housing base 510, and the pivot base 380. The spacer disk 390 and the pivot base 380 allow the housing base 510 to rotate with respect to the axis of rotation at the center of the spacer disk 390 in the direction of arrow C of FIG. 3. Thus, the lateral movement of the rod 344 resulting from the movement of the components described above affects the lateral component $\alpha$ of the trajectory angle.

The housing 500 is provided with slots 502 on the left and right sides thereof to allow the housing 500 to pivot with respect to the housing base 510 in the direction of arrow D of FIG. 3, thereby enabling the adjustment of the elevation component $\beta$ of the trajectory angle. The elevation component $\beta$ of the trajectory angle is also affected by the vertical height change of the rod 334 of the crank mechanism 330 with respect to the drive shaft 322 of the trajectory gear motor 320.

Thus, the trajectory of the clay 10 includes the lateral component a and the elevation component $\beta$. As the trajectory motor 320 rotates the drive shaft 322, the trajectory motor assembly 310 alters the lateral component a and the elevation component $\beta$ of the trajectory of the clay 10 through at least a portion of a conical pattern as shown in FIG. 3. As actuation of the trajectory motor 320 rotates the shaft 322, the trajectory of the clay cycles through the entire conical pattern.

Thus, the trajectory motor assembly 310 provides an automatic trajectory changer mechanism for providing a dynamic way of altering the trajectory angle of the clays 10. This dynamic way is in contrast to the conventional devices that permitted only very simple adjustments to the trajectory path, ones which were certainly not automatically and continuously changing as the device was operated. As previously mentioned, the user typically had to stop shooting and then manually adjust the device to alter the trajectory path or angle and then resume shooting. However, as soon as the user wanted to again alter the trajectory path or angle, the user again would need to stop and manually alter the trajectory angle.

Main Motor

Figure 6:
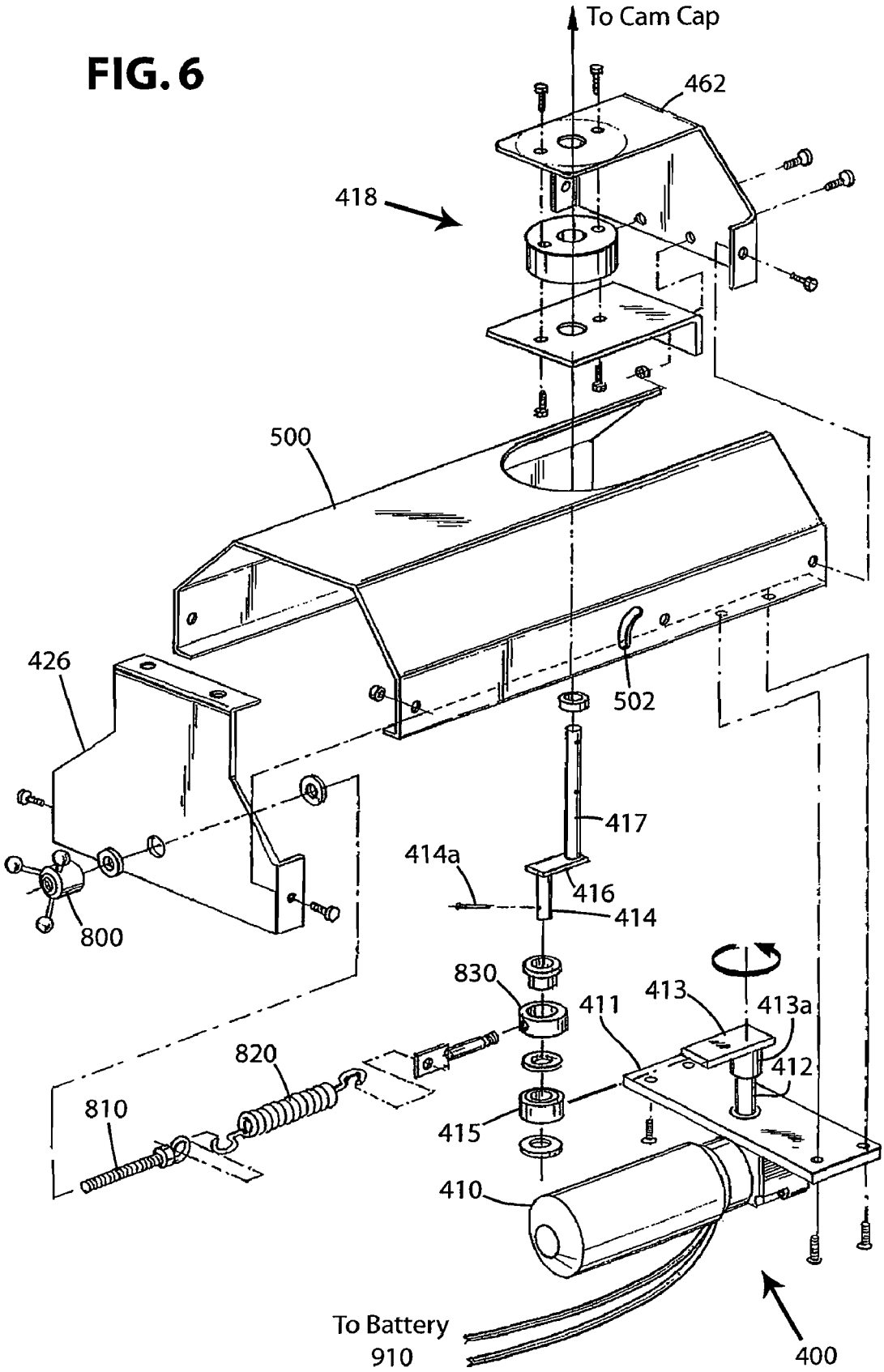
FIG. 6 is an exploded view of a speed ball handle and a main motor assembly of the trap machine of FIG. 1.
Figure 7:
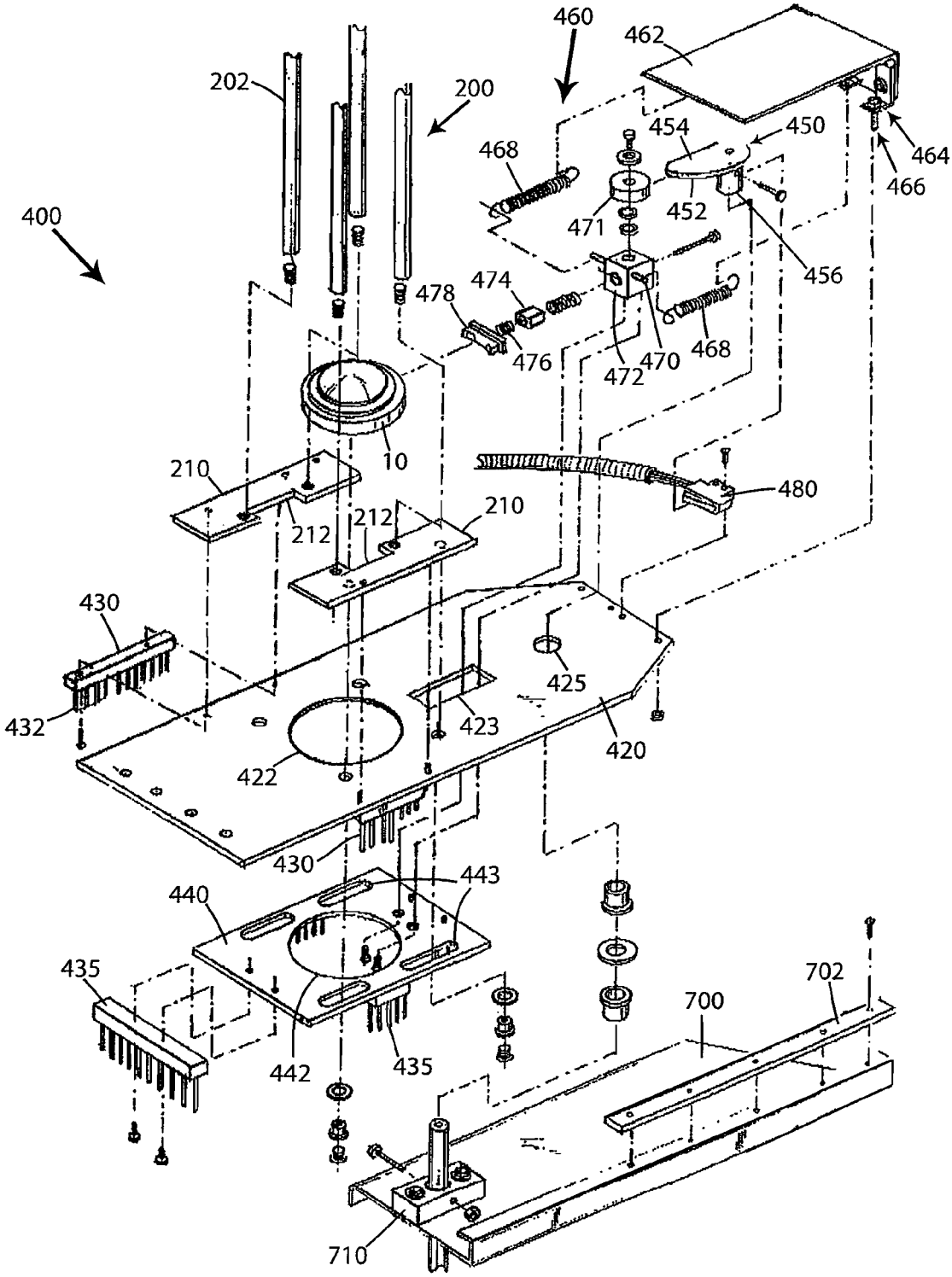
FIG. 7 is an exploded view of a magazine and the main motor assembly of the trap machine of FIG. 1.

FIG. 6 is an exploded view of a speed ball handle 800 and the main motor assembly 400 of the trap machine 100; FIG. 7 is an exploded view of the magazine 200 and the main motor assembly 400 of the trap machine 100; and FIG. 8 is an exploded view of the magazine 200 of the trap machine 100.

The main motor assembly 400 includes a main motor 410 that is fixedly mounted to the housing 500 and controls the actuation and movement of the throwing arm 700. The throwing arm 700 is cocked each time the main motor 410 rotates through one cycle, i.e., one revolution. By providing two separate motors, namely, the main motor 410 and the trajectory motor 320, to control the movement and relative positioning of the throwing arm 700 and the trajectory angle of the clays 10, the trap machine 100 provides the user with two different configurations. In the first configuration, the trap machine 100 shoots the clays 10 at a "fully automatic" continuously changing trajectory mode as described above, and in the second configuration, the trap machine 100 shoots the clays 10 repeatedly at a fixed trajectory mode, where the trajectory motor assembly 310 is turned off.

FIG. 9 is a sectional view of a control panel 900 of the trap machine 100 which is formed as part of the tail bracket 360. The control panel 900 includes two switches 902, 904, which can each be switched to one of three positions: "fully automatic," "off," and "trajectory only." The first switch 902 controls the power supplied to the main motor 410, which is indicated as M1 in FIG. 9, and the second switch 904 controls the power supplied to the trajectory gear motor 320, which is indicated as M2 in FIG. 9.

In the "fully automatic" continuously changing trajectory, the user switches the respective switches 902, 904 for the main motor 410 and the trajectory motor 320 to the "full auto on" positions, i.e., switched up, in the control panel 900. When the switches 902, 904 are in this position, power is supplied to both the trajectory motor 320 and the main motor 410. Then, the trajectory motor 320 rotates the crank mechanism 330 and stops as the main motor 410 stops in the armed or cocked position.

The rotational angle through which the trajectory motor 320 rotates the throwing arm 700 is determined by the difference in RPM of the trajectory motor 320 and the main motor 410. As will be appreciated that are a vast number of different motor selections that will yield a number of different RPM differences between the motors 320, 410. According to one exemplary embodiment of the invention as shown in FIG. 3, the main motor 410 has a 60 RPM rating, while the trajectory motor 320 has a 10 RPM rating. The RPM value (10) of the trajectory motor 320 divided by the RPM value (60) of the main motor 410 equals the fraction of the 360° cycle that the trajectory angle is changed. Thus, $360° \times (10/60) = 60°$. In other words, the trajectory angle changes 60° each time one clay 10 is launched.

With a 60° change in trajectory angle, the throwing arm 700 would launch a clay 10 in one of only 6 different positions per cycle (60°, 120°, 180°, 240°, 300°, and 360° from the original position). However, due to fluctuations in direct current (power supply), the change in trajectory angle slightly deviates from exactly 60°. Therefore, the positions usually never repeat exactly, and the trajectory of the clays continues to change because of the fluctuating nature of direct current (power supply).

An example of 6 consecutive trajectory angles are shown in FIG. 3, which shows the conical trajectory pattern that can be provided by the trap machine 100 of the present invention. It is understood that these 6 positions are achieved by positioning the trap machine, and particularly the housing 500, at 6 different configurations to achieve the 6 different lateral components $\alpha$ and elevation components $\beta$ of the 6 respective trajectory angles. However, only one configuration of the trap machine 100 is shown for simplicity.

It will be appreciated that in another alternative embodiment, one or more of the motors 320, 410 are of a type that has a variable speed so as to permit the user to controllably alter and change the RPM value for the one or more of the motors 320, 410 and thus alter the RPM ratio between the two motors, thereby varying the trajectory angle change each time the clay 10 is launched. For example, if the RPM ration of the main motor 410 remains at 60, but the trajectory motor 320 now has a 20 RPM rating. The RPM value (20) of the trajectory motor 320 divided by the RPM value (60) of the main motor 410 equals 120°, and therefore, the trajectory angle changes 120° each time one clay 10 is launched. By having at least one motor that can be programmed or controlled to vary the RPM of the motor, an increased level of continuous trajectory change can be incorporated into the machine 100. For example, the motor may be electronically connected to a control panel that has an input screen that permits the user to input the desired RPM speed of the motor, e.g., as by entering it through a key pad.

When a user wants to change the trap machine configuration from having a "fully automatic" continuously changing trajectory to a fixed trajectory, the user flips the switches 902, 904 for the trajectory and main motors 320, 410, respectively, to the "off" positions, i.e., switched to the center positions in the control panel 900 shown in FIG. 9. With the switches 902, 904 in this position, power is cut off from both motors 320, 410. Then, the user flips the switches 902, 904 to the "trajectory only on" positions, i.e., switched down in the control panel 900 shown in FIG. 9. When the switches 902, 904 are in this position, power is supplied to both motors 320, 410, but the main motor 410 allows power to pass through to the trajectory motor 320 so that the trajectory motor 320 changes the trajectory angle as described above. When the user has obtained the desired trajectory angle, the user flips the switch 904 for the trajectory motor 320 to the "off" position. Since the main motor switch 902 remains in the "trajectory only on" position, the trap machine 100 is able to repeatedly shoot clays at the selected fixed trajectory while keeping the trajectory motor switch 904 on the "off" position.

The trap machine 100 can be controlled using conventional techniques, including, the user operating a handheld control as shown in FIG. 2 or a foot pedal including a push button switch as shown in FIG. 3 to activate the trajectory motor to release the cocked throwing arm 700. Thus, the user can activate the trap machine at a distance from the trap machine using a remote activation device 102. However, it will be appreciated that any number of other mechanisms can likewise be used and it is within the scope of the present invention, that a handheld wireless controller can be used to release the throwing arm 700.

Magazine

The magazine 200 stores a single stack of the clays 10 and is mounted to a pair of thread plates 210 that form a part of the main motor assembly 400 as shown in FIG. 7. The magazine 200 includes a plurality of magazine tubes 202 that are connected by stack rings 204. Each magazine tube 202 has a male thread at the bottom end of the tube 202 and a female thread at the top end of the tube 202 to permit multiple tubes 202 to be easily axially connected to one another.

As shown in the embodiment of FIGS. 1-14, the magazine 200 contains four tubes 202 that are arranged about the perimeter of the clays 10 so as to surround and contain the clays 10. The four magazine tubes 202 are positioned in a generally square pattern in the magazine 200.

Alternatively, the magazine tubes 202 can be provided in tiers, which are separated by a stack ring 204, so that each tier includes a set of four magazine tubes 202. The number of tiers of the magazine is variable since the lengths of the tubes 202 can be varied, thereby resulting in differences in heights of the individual tiers. By dividing the overall length of the magazine tubes into smaller tube sections that are securely attached to one another at joints, the robustness of each of the magazine tubes along its entire length is maintained.

At the top of the magazine 200, one stack ring 204 is fastened to the female threads at the top ends of the magazine tubes 202 using bolts or another type of threaded fasteners. For a multi-tiered structure, the male threads at the bottom ends of top tier magazine tubes can be inserted through a second stack ring 204 and fastened to the female threads at the top end of the bottom tier magazine tubes, which are aligned with the top tier magazine tubes. However, in the present embodiment, the male threads at the bottom ends of the magazine tubes 202 are inserted through the thread plates 210 and fastened to the thread plates 210 using a bolt. Each thread plate 210 supports two magazine tubes 202. As shown in FIG. 7, the left side thread plate 210 supports the pair of magazine tubes 202 on the left side, and the right side thread plate 210 supports the pair of magazine tubes 202 on the right side of the trap machine 100. As shown, each of the thread plates 210 includes a notch or the like 212 that is aligned and oppose one another when the thread plates 210 are mounted in the housing 500 and more particularly, are mounted to a main deck 420 that is part of a clay release mechanism described below. The notches 212 permit travel of the clay 10 during operation of the machine 100.

The main deck 420 serves as a support surface for the magazine 200 and includes an opening, e.g., clay release hole 422, formed therethrough to permit passage of the clay 10 from the magazine 200 to the throwing arm 700. The main deck 420 also includes another opening, e.g., slot 423, that permits passage and connection between parts/components that lie above and below the main deck 420 as described below.

A gate mate 230 rests on top of the clay stack 10 in the magazine 200 and serves as a follower to ensure that the clays 10 feed uniformly all the way down the stack and to stabilize the clay stack, thereby preventing clay breakage. The gate mate 230 includes a tubular (or cylindrical) member (body) made of a material such as plastic, PVC, or another relatively lightweight material. A counterweight 232, such as a bolt, is inserted into a rear-facing surface of the tubular member 230. The counterweight 232 slides within the gap formed between the pair of magazine tubes 202 at the rear of the magazine 200. The stack rings 204 are formed with a cutout at the rear portion of the ring to allow the counterweight of the gate mate 230 to pass therethrough. Thus, the rear pair of magazine tubes 202 and the cutouts in the stack rings 204 guide the counterweight 232 as the gate mate 230 follows the clays 10 downward. Furthermore, since the trap machine 100 is tilted upwards at the front, the magazine 200 tilts toward the rear of the trap machine 100. Thus, gravity also acts to position the counterweight 232 so that it points rearward.

Since the trap machine of the present invention is designed to prevent clay breakage, such as by providing a gate mate, the magazine 200 can store at least 80 clays 10, which is more than a conventional trap machine.

Clay Release Assembly

The machine 100 also includes the clay release assembly that is positioned below the magazine 200 and includes the main deck 420, the pair of thread plates 210, two sweep rails 430, a moving gate 440 disposed on an underside of the main deck 420, a cam cap 450, and a clay clamp mechanism 460.

The main deck 420 is mounted to the rear side of the housing 500 via a rear cap 426. The rear cap 426 positions the main deck 420 so that there is a gap between the main deck 420 and a top surface of the housing 500. The throwing arm assembly 700, the sweep rails 430, and the moving gate 440 are positioned in this gap between the main deck 420 and the housing 500.

The moving gate 440 is slidingly mounted to the underside of the main deck 420. A number of fasteners, such as four shoulder bolts, are slidingly mounted in a corresponding number (e.g., four) of slots 443 in the moving gate 440 and the threaded ends of the shoulder bolts are inserted through holes in the main deck 420 and screwed into the thread plates 210. Thus, the moving gate 440 is allowed to slide with respect to the shoulder bolts, which are stationary with respect to the main deck 420 and the thread plates 210.

The main deck 420 includes the opening 422 (clay release hole) through which the clays 10 drop. The clay release hole 422 in the main deck 420 is aligned with the stack of clays 10, and the bottommost clay 10 is positioned within the clay release hole 422. The thread plates 210 are positioned on the respective left and right sides of the clay release hole 422 in the main deck 420 and are also formed with cutouts or notches 212 that allow the clays 10 to fall freely therethrough.

The moving gate 440 also includes a clay release hole 442. As the moving gate 440 slides with respect to the main deck 420, a clay 10 drops by gravity onto the throwing arm 700 when the clay release holes 442, 422 in the moving gate 440 and the main deck 420, respectively, are aligned. When the clay release holes 442, 422 in the moving gate 440 and the main deck 420 are aligned, the clay 10 drops to a clay launching position on the throwing arm 700 and located below the clay release holes 442, 422 in the gap between the main deck 420 and the housing 500. The clays 10 are launched by the throwing arm 700 from the clay launching position located in the gap between the main deck 420 and the housing 500.

Two side sweep rails 430 are mounted to the lower surface of the main deck 420 at a distance from the respective left and right sides of the clay launching position on the throwing arm 700. The sweep rails 430 are fastened via fasteners, such as bolts, which are inserted through holes in the main deck 420 and screwed into the thread plates 210.

The sweep rails 430 include bristles or the like 432 that help to position the clay 10 within the clay launching position on the throwing arm 700 while allowing debris and other foreign particles to fall away from the clay launching position. The bristles 432 are made of a flexible material that can retain its strength, such as plastic or nylon. The bristles 432 extend outwardly from a base that is mounted/positioned against the underside of the main deck 420.

Another set of sweep rails 435 is mounted to the lower surface of the moving gate 440. This set of sweep rails 435 is positioned at the rear, left, and right sides of the clay launching position on the throwing arm 700 when the throwing arm is cocked. These sweep rails 435 are identical to the sweep rails 430 mounted to the lower surface of the main deck 420 except that these rails mounted to the lower surface of the moving gate 440 may have different lengths, e.g., shorter, as shown in FIG. 7.

Thus, each of the thread plates 210 include three pairs of threaded holes 214 for mounting the magazine tubes 202, the shoulder bolts which guide the moving gate 440, and the side and rear sweep rails 430. The thread plates 210 are at least ⅜-inch thick and rest on the top surface of the main deck 420 of the housing 500. As described in relation to conventional trap machines, when the trap machine vibrates from the release and launch of the clays, the threaded connections tend to wear out first, thereby making the trap machine unstable. However, in the present invention, the threaded connections are provided by the thread plates 210. When the threads in the thread plates wear out, the user can simply replace the thread plates 210 and the corresponding fasteners instead of replacing the entire machine. The thread plates ensure the rigidity of the support for the magazine and moving gate. Thus, the present invention provides an easy to maintain, stable, and longer lasting trap machine as well as a much less costly machine to maintain and operate.

The machine 100 also includes the clay-clamp mechanism 460 for transferring the rotational motion of the main motor 410 to control the movement of the moving gate 440 and prevent the next clay 10 in the stack from being released with the bottommost clay 10. The clay clamp mechanism 460 includes a cam shroud 462, shroud mounting brackets 464, a pair of extension spring supporting rods 466, a pair of extension springs 468, a spring pin 470, a brake guide 472, a coupler 474, a compression spring 476, and a brake shoe 478.

The cam shroud 462 is disposed at the front of the main deck 420. The shroud mounting brackets 464 are right-angle brackets mounted to the inside vertical surface of the cam shroud 462 and the upper surface of the main deck 420. The pair of extension spring supporting rods 466 are inserted within slots in horizontal portions of the shroud mounting brackets 464.

One end of each of the extension springs 468 is connected to the respective extension spring supporting rods 466. The other ends of the extension springs 468 are connected to opposite ends of the spring pin 470, which is inserted into a hole extending laterally through the brake guide 472. The brake guide 472 is slidingly received in the slot 423 in the main deck 420 and is fixedly mounted to the front end of the moving gate 440. Thus, movement of the brake guide 472 is transferred to the moving gate 440.

The compression spring 476 is mounted to the rear surface of the brake guide 472, and the coupler 474 is connected to the back end of the compression spring 476. The brake shoe 478, such as a bicycle brake shoe, is mounted to the coupler 474. The brake shoe 478 is a rubber pad that holds the clay stack 10 in place as the bottommost clay is released onto the throwing arm 700. The extension springs 468 bias the brake guide 472, spring pin 470, compression spring 476, coupler 474, and brake shoe 478 toward the front of the trap machine 100 and toward the cam cap 450.

Main Motor Assembly

As shown in FIG. 6, the main motor 410 is positioned in the front of the housing 500 and is fastened to a motor mounting bracket 411, which is mounted to the bottom surface of the housing 500 so that the main motor 410 hangs below the housing 500. A drive shaft 412 of the main motor 410 extends through the motor mounting bracket 411 into the housing 500 and is then inserted into a bore in a shaft portion 413*a* of a motor (lower) crank 413. The motor crank 413 receives rotational motion from the drive shaft 412 of the main motor 410.

An upper crank 416 is positioned above the motor crank 413 and includes a passive shaft 414 that is fixed to the upper crank 416 and extends downward from the lower surface of the upper crank 416. A bearing 415 and a collar 830 are rotatably mounted onto the passive shaft 414. A pin 414*a* is inserted onto the distal end of the passive shaft 414 to retain the bearing 415 and the collar 830 on the passive shaft 414.

The upper crank 416 is also fixed to a main shaft 417, which is colinear to the drive shaft 412 of the main motor 410. Thus, there is an offset distance between the passive shaft 414 and the line along which the drive shaft 412 and the main shaft 417 are aligned.

The motor crank 413 rotates via rotational motion from the drive shaft 412 and the main motor 412, and the motor crank 413 transfers the rotational motion to the bearing 415 on the passive shaft 414. Thus, the motor crank 413 applies a force on an outside surface of the bearing 415 to urge the passive shaft 414 to rotate around an axis that is colinear with the main shaft 417.

The main shaft 417 is positioned in the front of the housing 500 and inserted through a clutch assembly 419, which is located in the front of the housing 500 below the connection between the main shaft 417 and the cam cap 450. The main shaft 417 is inserted into the clutch assembly 419, extends upward through the top of the housing 500, and is inserted into a drive shaft insertion hole 425 in the main deck 420 so that the top end of the main shaft 417 extends upward through the main deck 420.

Figures 10, 10A:
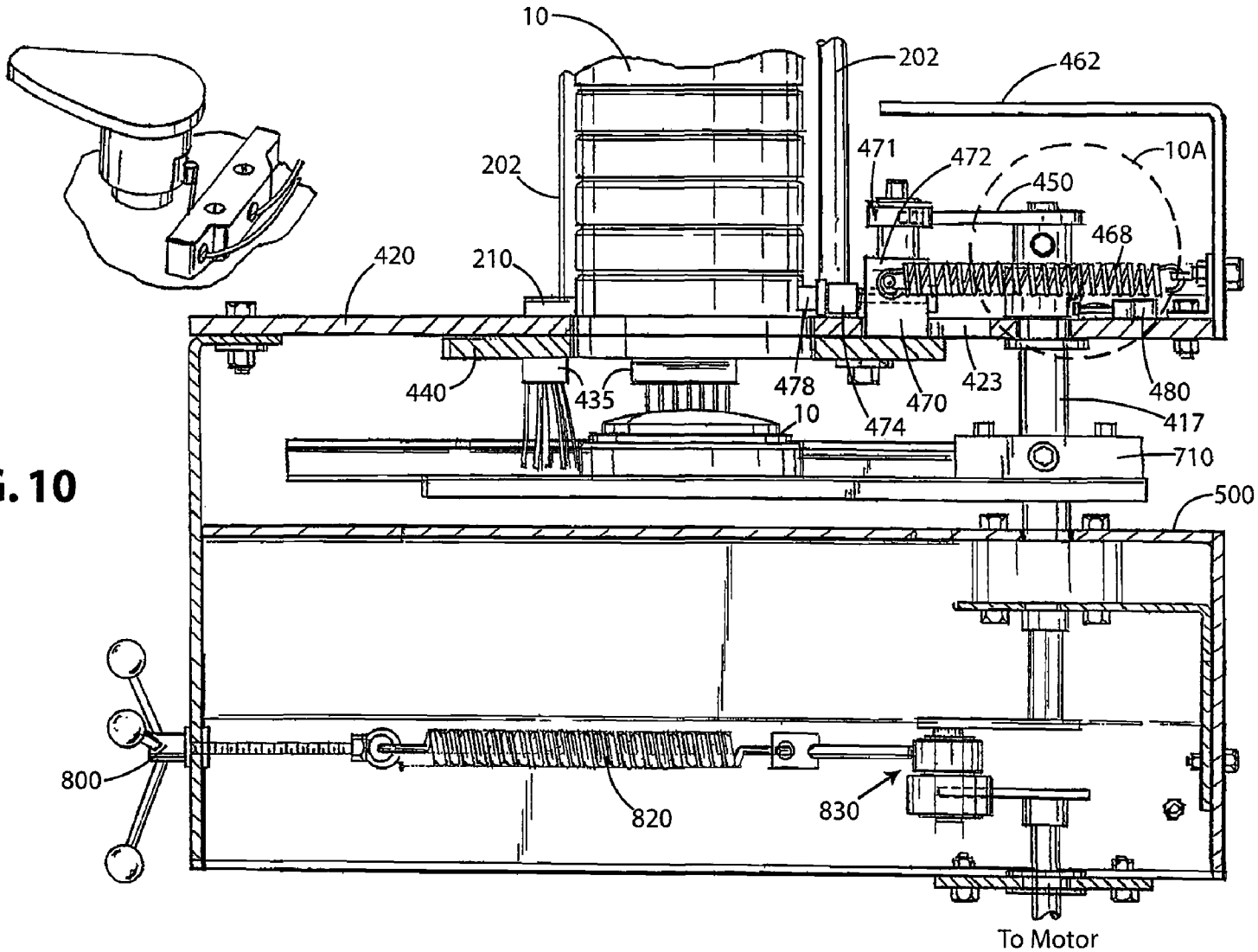
FIG. 10 is a sectional view of the magazine, main motor assembly, and throwing arm of the trap machine of FIG. 1 where the clay is in the clay release position on the throwing arm.
FIG. 10*a* is a close-up perspective view of a cam cap and switch member in an open position.
Figure 11:
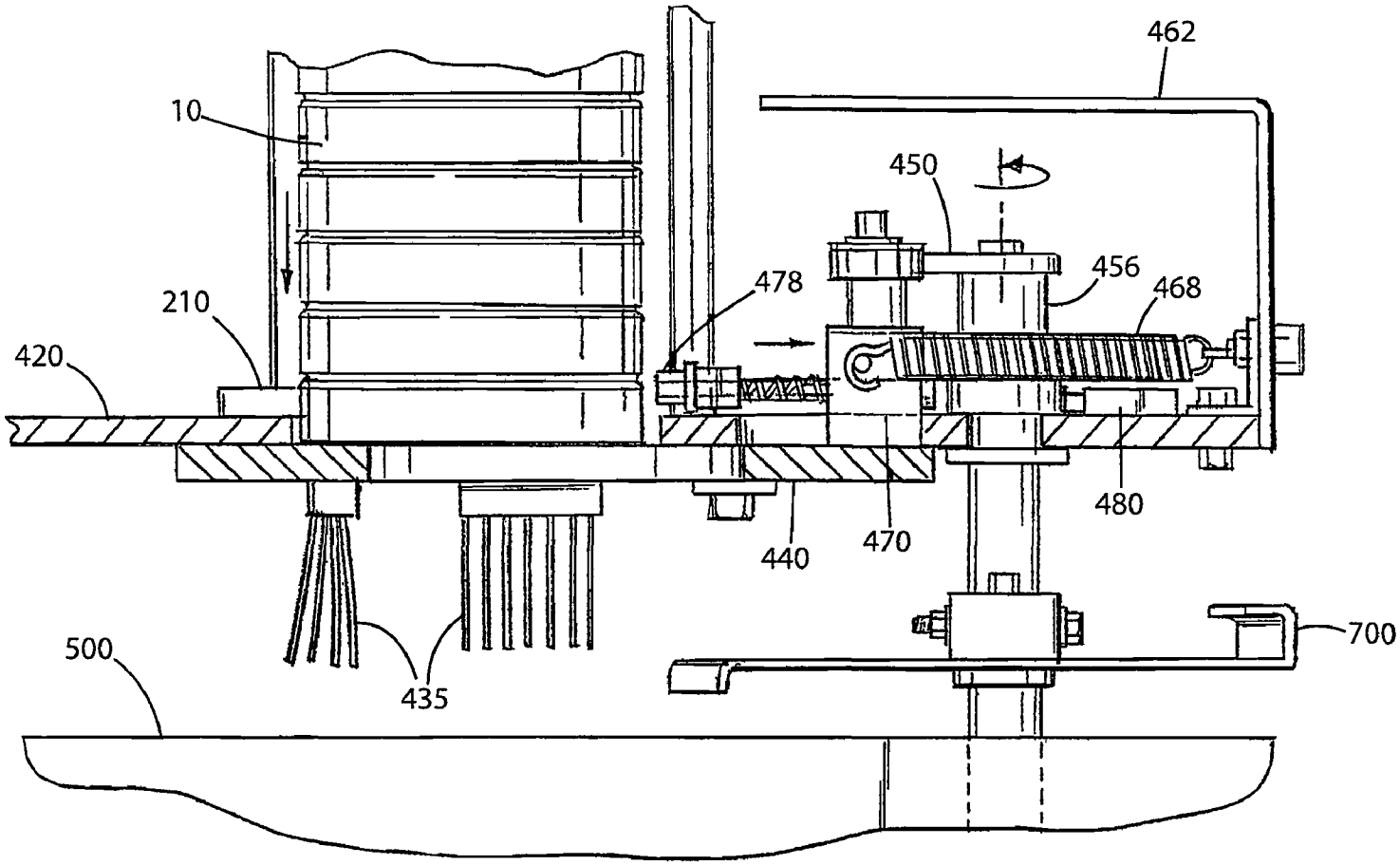
FIG. 11 is a sectional view of the magazine, main motor assembly, and throwing arm of the trap machine of FIG. 1 when the throwing arm moves to the cocked position after the clay is launched.
Figure 12:
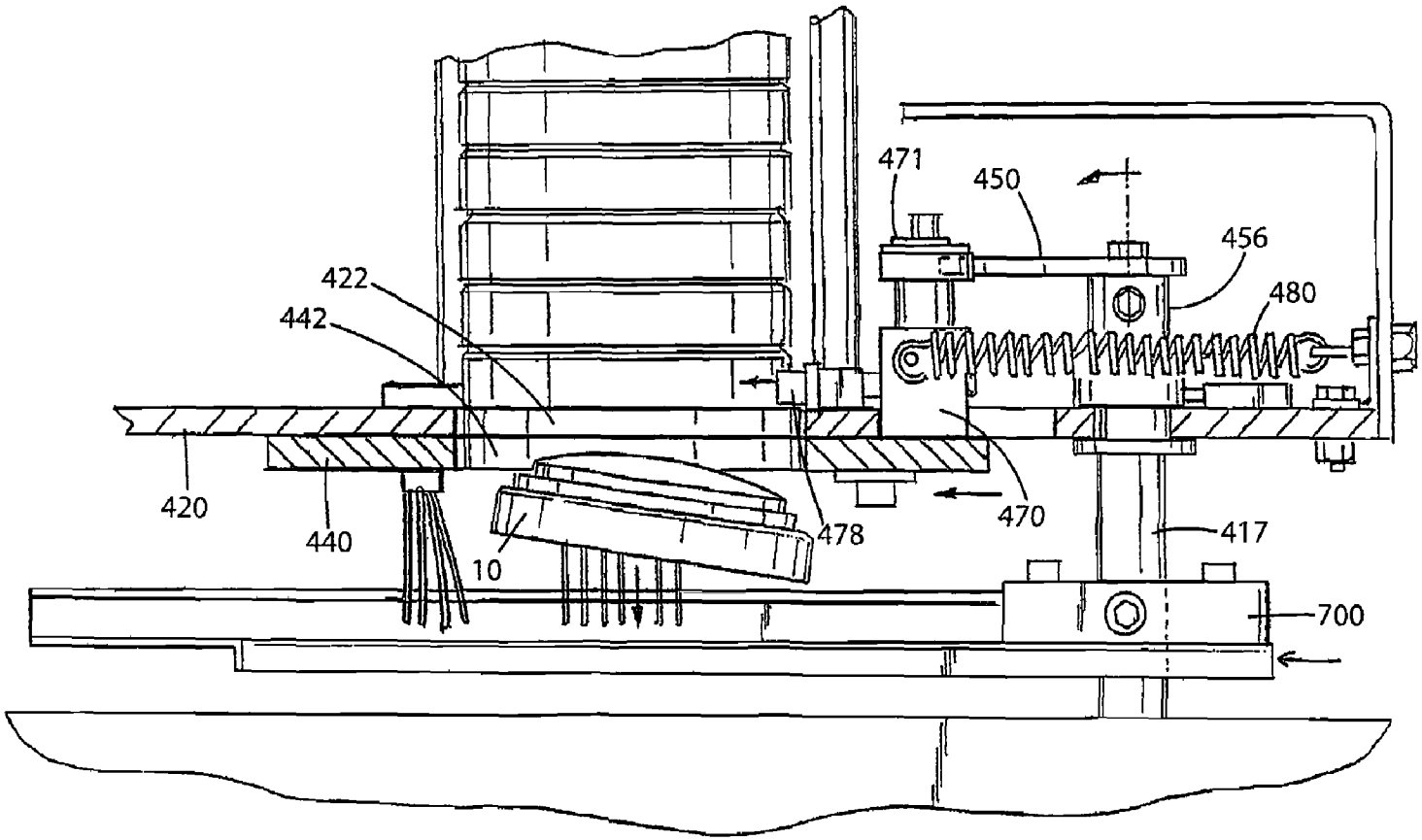
FIG. 12 is a sectional view of the magazine, main motor assembly, and throwing arm of the trap machine of FIG. 1 when the throwing arm is cocked and the bottommost clay is dropped to the clay release position on the throwing arm.
Figure 14:
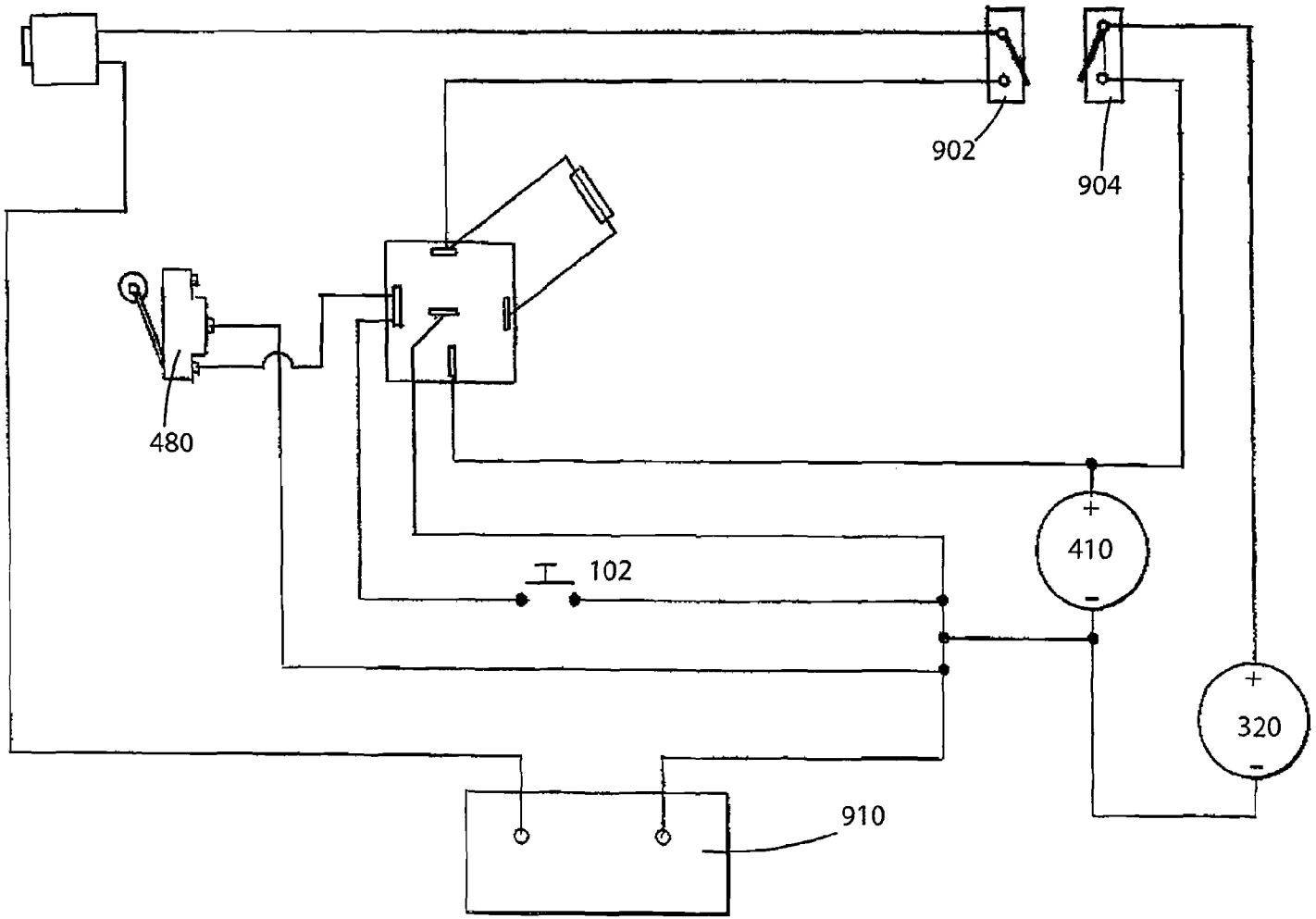
FIG. 14 is a schematic diagram of the electrical connections between the motors, the switches, and a battery of the trap machine of FIG. 1.

FIGS. 10-12 illustrate three positions of the trap machine 100. FIG. 10 is a sectional view of the magazine 200, main motor assembly 400, and throwing arm 700 of the trap machine 100 where the clay 10 is in the clay release position on the throwing arm 700; FIG. 11 is a sectional view of the magazine 200, main motor assembly 400, and throwing arm 700 of the trap machine 100 when the throwing arm 700 moves to the cocked position after the clay 10 is launched; and FIG. 12 is a sectional view of the magazine 200, main motor assembly 400, and throwing arm 700 of the trap machine 100 when the throwing arm 700 is cocked and the bottommost clay 10 is dropped to the clay release position on the throwing arm 700. In these Figures, the side sweep rail 430 is omitted for clarity. FIG. 14 is a schematic diagram of the electrical connections between the motors 320, 410, the switches 480, 902, 904, and a battery 910 of the trap machine 100.

As shown in FIG. 7, the clay clamp mechanism 460 is activated by the cam cap 450, which receives rotational motion from the main shaft 417 (FIG. 6 and described below) that receives rotational motion from the drive shaft 412 of the main motor 410. The cam cap 450 includes a cam surface 452 on one side of the cam cap 450 and a relatively flat surface 454 on the opposite side of the cam cap 450. The cam cap 450 also includes a shaft portion 456, which receives the top end of the main shaft 417 that receives rotational motion from the main motor 410 so that rotational motion is transferred from the main motor 410 to the cam cap 450. The cam cap 450 rotates in the counterclockwise direction as shown by arrow A shown in FIGS. 2 and 3, when viewing the cam cap 450 from above the trap machine 100.

A bearing 471 is mounted on top of the brake guide 472. As the main motor 410 rotates the cam cap 450, the location of the bearing 471 and the brake guide 472 is determined by position of the cam surface 452 relative to the bearing 471. When the cam cap 450 rotates to extend frontward, the cam surface 452 is located at a distance from the bearing 471 and the extension springs 468 bias the brake guide 472 and bearing 471 frontward.

When the cam cap 450 rotates to extend rearward, the bearing 471 contacts the cam surface 452 at a point close to the axis of rotation of the cam cap 450. As the cam surface 452 continues to rotate, the bearing 471 is forced farther away from the axis of rotation of the cam cap 450, thereby forcing the brake guide 472 farther away from the cam cap 450 rearward. The extension springs 468 provide some resistance to the movement of the guide block. The moving gate 440 moves rearward with the brake guide 472 since the moving gate 440 is fixed to the brake guide 472. The moving gate 440 is guided by the shoulder bolts disposed in the slots 443 in the moving gate 440. The brake guide 472 and the moving gate 440 move rearward until the brake shoe 478 contacts the second-to-bottom clay 10 in the clay stack. At this time, the clay releasing holes 442, 422 in the moving gate 440 and the main deck 420 align, and the bottommost clay 10 drops onto the cocked throwing arm positioned underneath the clay releasing holes 442, 422. As the bearing 471 proceeds along the cam surface 452 toward a tip of the cam cap 450, the brake shoe 478 presses into the second-to-bottom clay 10 in the clay stack, which has now become the bottommost clay 10 in the clay stack.

When the bearing 471 passes the tip of the cam cap 450, the cam cap 450 is no longer rearward by the bearing 471. Since there is no resistance to the bearing 471, the brake guide 472, the bearing 471, and the brake shoe 478 move frontward under the spring force of the extension springs 468 and the brake shoe 478 releases its hold on the new bottommost clay 10 in the clay stack. The main motor 410 then proceeds to rotate the cam cap 450 frontward so that it extends toward the front of the trap machine 100.

The cam cap 450 also controls the timing of the throwing arm 700, which launches the clays 10 from the trap machine 100. The embodiment of the present invention described herein incorporates a throwing arm 700 as the launching mechanism. However, it is to be understood that the throwing arm 700 can be replaced by another type of launching mechanism.

As described above, the clays 100 drop onto the throwing arm when the clay releasing holes 422, 442 in the main deck 420 and the moving gate 440 align. The throwing arm 700 is positioned in the gap between the main deck 420 and the housing 500. The throwing arm 700 includes a strip 702 that contacts a side or edge of the clay 10 to force it in the launching direction, i.e., toward the front of the trap machine 100.

An arm clevis 710 is mounted to the throwing arm 700, and the main shaft 417 that receives rotational motion from the main motor 410 is inserted into a hole in the arm clevis 710. A fastener rotatably fixes the main shaft 417 with respect to the arm clevis 710 so that the arm clevis 710 and the throwing arm 700 rotate with the main shaft 417.

The gap is unobstructed between the front ends of the housing 500 and main deck 420 to allow the throwing arm 700 to extend outward when it cycles through the cocking process. The profile of the cam surface 452 allows the brake guide 472 and its associated parts, such as the moving gate 440 and brake shoe 478, to move relatively slowly while the bearing 471 contacts the cam surface 452 and relatively quickly right after the bearing 471 passes the tip of the cam surface 452. Since the throwing arm 700 is connected to the cam cap 450 so that they rotate together, the throwing arm 700 also moves relatively slowly while the bearing 471 contacts the cam surface 452 and relatively quickly right after the bearing 471 passes the tip of the cam surface 452. When the throwing arm 700 is moving relatively slowly, the throwing arm 700 is positioned in the cocked position within the gap between the main deck 420 and the housing 500 before the bottommost clay 10 is released onto the throwing arm 700 in the clay launching position. When the throwing arm 700 is moving relatively quickly, it is in the process of being cocked.

A snap switch 480, shown in FIGS. 7 and 10-12, is positioned next to the cam cap 450 and is fastened to the front edge of the main deck 420. The cam cap 450 is located above the main deck, and the shaft portion 456 of the cam cap 450 is positioned in front of the snap switch 480. The snap switch 480 is normally in the open position as shown in FIG. 10*a*.

The shaft portion 456 of the cam cap 450 includes a timing flat 458 is positioned facing the snap switch 480 when the arm is in the cocked position. Since the snap switch 480 is normally in the open position, the snap switch 480 breaks the circuit shown in the schematic diagram of FIG. 14 when the arm is in the cocked position. When the circuit is broken, power is not supplied to the main motor 410, and power is supplied to the main motor 410 when activated by the user, e.g., when the user activates the remote activation device 102.

When the user activates the remote activation device 102, the throwing arm 700 launches the clay 10 which has been loaded onto the arm 700, and the arm becomes uncocked. At an uncocked position, the timing flat 458 is positioned away from the snap switch 480, and the rounded shaft portion 456 of the cam cap 450 provides constant contact with the snap switch 480, thereby closing the circuit. When the switch 480 is in this closed position, power is supplied to the main motor 410 and the main motor assembly 400 moves the throwing arm 700 toward the cocked position.

When the arm 700 has reached the cocked position, the timing flat 458 on the shaft portion 456 of the cam cap 450 no longer contacts the snap switch 480, and the snap switch 480 is again in the open position, and power is cut off to the main motor 410. As before, the motor 410 remains in the cocked position until the user hits the remote activation device 102 to power the main motor 410, which reactivates the throwing arm 700 to launch the clay 10 that has been loaded onto the throwing arm 700. This cycle repeats if the user continues pressing the remote activation device 102 and until power runs out of the battery 910.

Housing

As shown in FIGS. 1-3, the housing 500 is formed so that the upper edges are chamfered, i.e., sloped downward on the left and right upper edges. If a clay 10 breaks, the broken pieces will fall away from within the gap between the main deck 420 and the housing 500 by sliding down the chamfered edges of the housing 500.

Thus, unlike the box-shaped housings of the prior art where clay debris gathers in this central area, the present invention can prevent potential jamming by allowing the debris to fall away from this central area on top of the housing 500.

Speed Ball Handle

A speed ball handle 800 is provided at the rear of the trap machine 100 for allowing the user to modify the speed of the throwing arm 700 and is inserted through a hole in the rear cap 426 of the housing 500. The speed ball handle 800 is operatively connected to a threaded end of an eye bolt 810, and a spring 820 is connected to the other end of the eye bolt 810. The other end of the spring 820 is attached to the collar 830, which is rotatable around the passive shaft 414 of the main motor assembly 400, as shown in FIG. 6.

The main shaft 417 transfers rotational motion to the clay clamp mechanism 460 and is rotated by the drive shaft 412 of the main motor 410 via the main motor assembly 400. The main motor assembly 400 also includes the passive shaft 414, which is mounted to the motor crank 413 such that the passive shaft 414 is offset from the drive shaft 412 of the main motor 410. However, the passive shaft 414 rotates around an axis that is colinear with the drive shaft 412.

The collar 830 is supported by the passive shaft 414 of the main motor assembly 400 so that it is free to rotate around the passive shaft 414. Thus, when the speed ball handle 800 increases the tension in the spring 820 by extending the spring 820, the spring 820 resists the rotational motion of the passive shaft 414 and the main motor 410. Hence, the speed of the throwing arm 700 increases when the user turns the speed ball handle 800 to extend the spring 820.

When the user decreases the tension in the spring 820 by releasing the spring 820, the spring 820 provides less resistance to the rotation of the passive shaft 414 and the main motor 410. Hence, the speed of the throwing arm 700 decreases when the user turns the speed ball handle 800 to release the spring 820.

Conventional trap machines provide a speed adjustor for the throwing arm that requires a wrench. However, the present invention provides a more user friendly design for speed control of the throwing arm.

Low Clay Alarm

In yet another feature, the present invention can include a low clay alarm 850 that notifies the user using a siren, a beeper, or another type of signal when the height of the clay stack 10 in the magazine 200 has fallen below a predetermined level. Typically, the low clay alarm 850 is configured to sound off when only 3-4 clays 10 are available in the magazine 200.

Figure 13:
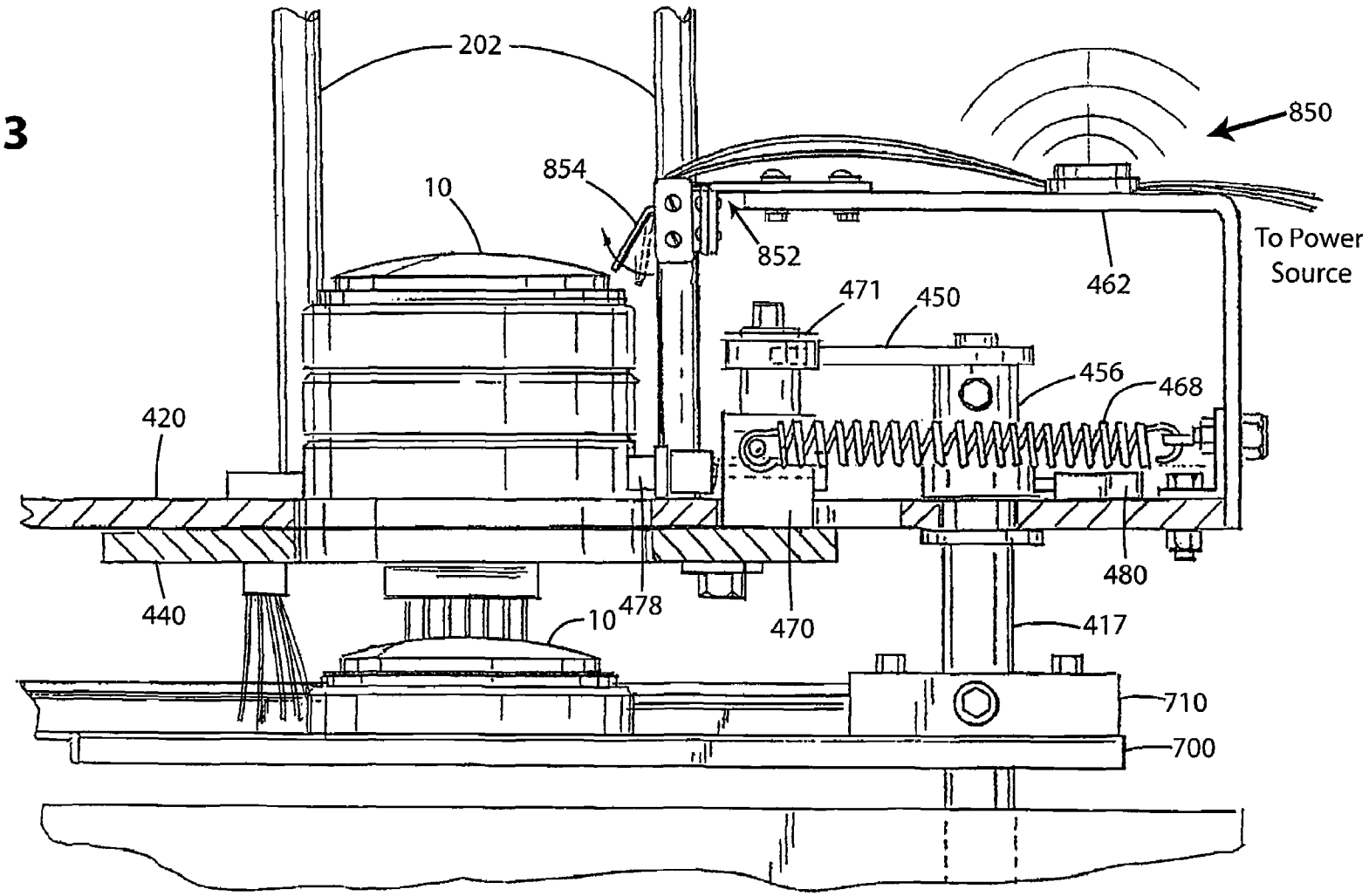
FIG. 13 is a sectional view of the magazine, main motor assembly, throwing arm, and a low clay alarm of the trap machine of FIG. 1.

FIG. 13 is a sectional view of the magazine 200, main motor assembly 400, throwing arm 700, and a low clay alarm 850 of the trap machine 100. The low clay alarm 850 is mounted to the cam shroud. A right-angle bracket 852 is mounted to the cam shroud so that a horizontal surface is mounted flush against the top surface of the cam shroud and a vertical portion of the right-angle bracket 852 is mounted to extend vertically downward from the horizontal portion.

A low clay snap switch 854 is fastened to the vertical portion of the right-angle bracket 852, facing the clay stack 10. Slots in the horizontal and vertical portions of the right-angle bracket 852 allow the low clay snap switch 854 to be fastened to the vertical portion and allow the horizontal portion to be fastened to the cam shroud. The low clay snap switch 854 is electrically connected to a mini siren or buzzer that provides the audible signal for the low clay alarm 850.

The slots in the horizontal and vertical portions of the right-angle bracket 852 also allow the user to adjust the positioning of the right-angle bracket 852 horizontally with respect to the cam shroud and to adjust the low clay snap switch 854 vertically with respect to the right-angle bracket 852.

The low clay snap switch 854 is positioned close enough to contact the clay stack at the lowest level that the clay stack 10 can reach before the alarm sounds. As shown in FIG. 13, when there are enough clays 10 in the clay stack to remain above the predetermined lowest level, the low clay snap switch 854 remains in the closed position.

As shown in FIG. 13, when enough clays 10 are fed through the trap machine 100 so that the height of the clay stack 10 descends below the level of the low clay snap switch 854, the low clay snap switch 854 moves to an open position, which signals the alarm 850 to sound. When the alarm 850 sounds, the remote activation device 102, e.g., a hand-held or foot-firing remote control or a push button switch, can be deactivated until the clays are reloaded above the predetermined level of the low clay snap switch 854.

The low clay alarm 850 is particular advantageous when using the trap machine 100 at a distance from the user, such as when the trap machine 100 is concealed or far away and the user is activating the trap machine 100 by the remote activation device 102.

Having described embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A clay target launching machine comprising:

a magazine containing a predetermined number of clay targets;

a first motor assembly;

a throwing arm operatively coupled to the first motor assembly such that actuation of the first motor assembly is translated into pivoting of the throwing arm to launch the clay target;

a housing that is pivotable about a base and supports, at least in part, the magazine, the first motor assembly, and the throwing arm; and an automatic trajectory changer assembly including a second motor that is operatively coupled to the housing through a linkage such that rotation of a drive shaft of the second motor is translated into vertical and lateral movement of the housing relative to the base so as to cause a continuous change in an angle at which the throwing arm is positioned when launching clays, thereby causing a variable trajectory path for successively launched clay targets;

wherein the first motor assembly operates at a different speed than the second motor, wherein the linkage includes a drive shaft that is coupled to the housing, with the drive shafts of the second motor and the linkage being axially offset from one another.

2. The launcher of claim 1, wherein the first motor assembly and second motor are electrically connected to one another such that actuation of the first motor assembly causes actuation of the second motor in a first mode of operation.

3. The launcher of claim 2, wherein actuation of the second motor causes the drive shaft to rotate a prescribed angle which is calculated as a ratio between: (RPM speed of second motor/RPM speed of first motor assembly).

4. The launcher of claim 1, wherein the variable trajectory path is defined by a predetermined number of launch positions per cycle, wherein a change in a trajectory angle between the launch positions per cycle is calculated according to the equation: 360°×(RPM speed of second motor/RPM speed of first motor assembly).

5. The launcher of claim 1, wherein the magazine comprises a number of elongated members arranged according to a pattern with a stack of clays being contained therebetween, first ends of the elongated members being fastenly attached to a pair of thread plates which are supported on and mounted to a main deck that includes a first opening formed therethrough to permit selective passage of the clay target to the throwing arm.

6. The launcher of claim 1, wherein the linkage comprises:

a crank mechanism that has a first portion that is connected to the drive shaft of the second motor such the crank mechanism and the drive shaft rotate in unison, the crank mechanism including a crank shaft; and a slip-tube that is fixedly attached via a link to a tail bracket that forms a part of the housing, the crank shaft being slidingly receiving through a bore of the slip-tube such that the slip-tube can freely slide longitudinally along a length of the crank shaft such that that rotation of the drive shaft of the second motor is translated into rotation of the crank mechanism resulting in vertical and lateral pivoting movements of the housing relative to the base.

7. The launcher of claim 6, wherein the crank shaft is co-linear but axially offset from the drive shaft of the second motor.

8. The launcher of claim 1, wherein the trajectory path is a conically shaped.

9. The launcher of claim 1, wherein a ratio of the RPM speed of second motor/RPM speed of first motor assembly is between about 1:2 and about 1:24.

10. The launcher of claim 1, wherein the trajectory path includes, per one cycle, between about 2 and about 24 launch positions.

11. A clay target launching machine comprising:

a magazine containing a predetermined number of clay targets;

a first motor assembly;

a throwing arm operatively coupled to the first motor assembly such that actuation of the first motor assembly is translated into pivoting of the throwing arm to launch the clay target;

a housing that is pivotable about a base and supports, at least in part, the magazine, the first motor assembly, and the throwing arm;

an automatic trajectory changer assembly including a second motor that is operatively coupled to the housing through a linkage such that rotation of a drive shaft of the second motor is translated into vertical and lateral movement of the housing relative to the base so as to cause a continuous change in an angle at which the throwing arm is positioned when launching clays, thereby causing a variable trajectory path for successively launched clay targets, wherein the first motor assembly operates at a different speed than the second motor; and a frame supporting each of the magazine, the first motor assembly, the throwing arm, the housing, and the automatic trajectory changer assembly, wherein the base of the housing is mounted to the frame with a predetermined degree of list being incorporated therein by positioning a list block between a portion of the base and the frame.

12. A clay target launching machine comprising:

a magazine containing a predetermined number of clay targets;

a first motor assembly;

a throwing arm operatively coupled to the first motor assembly such that actuation of the first motor assembly is translated into pivoting of the throwing arm to launch the clay target;

a housing that is pivotable about a base and supports, at least in part, the magazine, the first motor assembly, and the throwing arm;

an automatic trajectory changer assembly including a second motor that is operatively coupled to the housing through a linkage such that rotation of a drive shaft of the second motor is translated into vertical and lateral movement of the housing relative to the base so as to cause a continuous change in an angle at which the throwing arm is positioned when launching clays, thereby causing a variable trajectory path for successively launched clay targets, wherein the first motor assembly operates at a different speed than the second motor and the second motor has a first drive shaft associated therewith and the linkage has a second drive shaft associated therewith that is coupled to the housing, with the first and second drive shafts being axially offset from one another, the second motor altering a lateral component and an elevation component of the clay target through at least a portion of the trajectory path that has a conical shape; and a stabilizing member resting on top of an uppermost clay target of the plurality of clay targets as they are advanced in the magazine, the stabilizing member having a base and a counterweight that is associated with one section of the base, the stabilizing member serving as a follower to ensure uniform feed of the clay targets and to stabilize the clay targets in the magazine.

13. The launcher of claim 12, wherein the magazine comprises a number of upstanding elongated members arranged according to a pattern with a stack of clays being contained therebetween, the elongated members being connected to one another by a plurality of stack rings that are spaced along a height of the magazine, each stack ring having a feature formed therein to permit passage of the counterweight of the stabilizing member as it follows the clay targets downward within the magazine.

14. A clay target launching machine comprising:

a magazine containing a predetermined number of clay targets;

a launching device for launching one of the clay targets;

a main motor assembly supporting at least a part of the magazine, the main motor assembling comprising a main motor that activates the launching device; and an automatic trajectory changer assembly comprising:

a trajectory gear motor that automatically changes the orientation of the main motor assembly and a trajectory of the clay target;

a pivot base disposed under a housing of the main motor assembly; and a linkage connected to the main motor assembly; wherein:

the trajectory gear motor transfers rotational motion to the linkage; and the linkage transfers the rotational motion to the main motor assembly, thereby causing the main motor assembly to pivot with respect to the pivot base, thereby changing the trajectory of the launched clay target, wherein the trajectory gear motor is operable to alter a lateral component and an elevation component of the clay target through at least a portion of a conical pattern and a speed of each of the main motor and the trajectory gear motor is variable.

15. A clay target launching machine comprising:

a magazine containing a predetermined number of clay targets;

a launching device for launching one of the clay targets;

a main motor assembly supporting at least a part of the magazine, the main motor assembling comprising a main motor that activates the launching device; and an automatic trajectory changer assembly comprising:

a trajectory gear motor that automatically changes the orientation of the main motor assembly and a trajectory of the clay target;

a pivot base disposed under a housing of the main motor assembly; and a linkage connected to the main motor assembly; wherein the trajectory gear motor transfers rotational motion to the linkage; and the linkage transfers the rotational motion to the main motor assembly, thereby causing the main motor assembly to pivot with respect to the pivot base, thereby changing the trajectory of the launched clay target, wherein a RPM speed of the trajectory gear motor is different than the RPM speed of the main motor and the RPM speed of at least one of the trajectory gear motor and main motor is programmable.

16. The clay target launching machine of claim 15 wherein:

the linkage comprises a crank mechanism having a clevis and a rod; and the automatic trajectory changer assembly comprises a slip tube attached via a link to the main motor assembly, the slip tube disposed to slide over the rod of the crank mechanism;

the trajectory gear motor transfers rotational motion to the clevis of the crank mechanism; and the slip tube slides along the rod of the crank mechanism to allow the main motor assembly to pivot with respect to the pivot base.

17. The clay target launching machine of claim 15 wherein:

the launching device comprises a throwing arm for launching the clay target;

the main motor assembly further comprises:

a cam cap comprising a cam portion and a shaft portion with a rounded portion and a timing flat; and a snap switch;

the throwing arm rotates when the snap switch contacts the rounded portion of the shaft portion of the cam cap; and the throwing arm stops rotating when the snap switch contacts the timing flat of the shaft portion of the cam cap.

18. The clay target launching machine of claim 17 wherein the throwing arm is in the cocked position when the snap switch contacts the timing flat of the shaft portion of the cam cap.

19. The clay target launching machine of claim 17 further comprising an activation device that activates the rotation of the throwing arm when the snap switch contacts the timing flat of the shaft portion of the cam cap.

20. The clay target launching machine of claim 15 wherein the main motor assembly further comprises:

a deck assembly;

a moving gate with at least one slot; and at least one shoulder bolt mounted to the deck assembly, the shoulder bolt being slidingly disposed within the slot of the moving gate to allow the moving gate to slide with respect to the deck assembly.

21. The clay target launching machine of claim 20 wherein:

the magazine is positioned above the deck assembly and the moving gate;

the deck assembly and the moving gate each include a clay release hole.

22. The clay target launching machine of claim 21 wherein:

the clay targets contained in the magazine are positioned above the clay release holes of the deck assembly and the moving gate when the clay release holes of the deck assembly and the moving gate are aligned; and a bottommost clay target in the magazine is allowed to fall through the clay release holes when the clay release holes of the deck assembly and the moving gate are aligned.

23. The clay target launching machine of claim 21 wherein:

the launching device is positioned below the deck assembly and the moving gate;

the main motor assembly further comprises a sweep rail mounted to the deck assembly;

the sweep rail is positioned at the rear of the clay release holes of the deck assembly and the moving gate;

the sweep rail prevents the clay target from sliding toward the rear of the main motor assembly when the clay target is positioned on the launching device.

24. The clay target launching machine of claim 20 wherein:

the main motor assembly further comprises a brake guide disposed on the moving gate;

the brake guide urges a brake shoe against a clay target in the magazine against an inside surface of the magazine.

25. The clay target launching machine of claim 15 wherein the main motor assembly further comprises a main deck and at least one replaceable thread plate with threaded holes mounted to the main deck; and the magazine is mounted to the threaded holes of the replaceable thread plate.

26. The clay target launching machine of claim 25 wherein the main motor assembly comprises at least one sweep rail mounted to the threaded holes of the replaceable thread plate.

27. The clay target launching machine of claim 25 wherein:

the main motor assembly comprises a moving gate with a pair of slots and a pair of shoulder bolts mounted to the threaded holes of the replaceable thread plate; and the shoulder bolts are slidingly disposed within the slots of the moving gate to allow the moving gate to slide.

28. The clay target launching machine of claim 15 wherein:

the main motor assembly further comprises a main spring with one end connected to a collar that is rotatable around a shaft that receives rotational motion from the main motor; and tension of the main spring is adjustable by extending or releasing the main spring.

29. The clay target launching machine of claim 28 wherein the shaft around which the collar rotates is offset from the crankshaft of the main motor by a predetermined distance.

30. The clay target launching machine of claim 15 further comprising a gate mate positioned on a stack of the clay targets in the magazine, wherein the gate mate comprises a counterweight disposed toward a rear of the gate mate.

* * * * *